US006318842B1

(12) United States Patent
Shimomura et al.

(10) Patent No.: US 6,318,842 B1
(45) **Date of Patent: *Nov. 20, 2001**

(54) LIQUID JET PRINTING HEAD AND LIQUID JET PRINTING APPARATUS PROVIDED WITH SAID LIQUID JET PRINTING HEAD

(75) Inventors: Akihiko Shimomura; Masatsune Kobayashi, both of Yokohama; Shigeo Toganoh, Tokyo; Isao Imamura, Yokohama; Shoji Shiba, Sagamihara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/755,358

(22) Filed: Nov. 25, 1996

Related U.S. Application Data

(6362) Continuation of application No. 08/240,708, filed as application No.PCT/JP93/01271 on Sep. 8, 1993, now abandoned.

(30) Foreign Application Priority Data

Sep. 8, 1992 (JP) ..... 4-239714
Sep. 14, 1992 (JP) ..... 4-245044

(51) Int. Cl.[7] ..... B41J 2/135
(52) U.S. Cl. ..... 347/45; 347/47
(58) Field of Search ..... 347/45, 47

(56) References Cited

U.S. PATENT DOCUMENTS 4,499,480 * 2/1985 Takatori ..... 347/45 X
5,032,641 * 7/1991 Nanishi ..... 524/544
5,365,255 * 11/1994 Inoue ..... 347/45

FOREIGN PATENT DOCUMENTS

403133650 * 6/1991 (JP) ..... B41J/2/06
357157765 * 9/1982 (JP) ..... B41J/3/04
361291148 * 12/1986 (JP) ..... B41J/3/04
57-175765 9/1992 (JP) ..... B41J/3/04

* cited by examiner

*Primary Examiner*—Joan Pendegrass
(74) *Attorney, Agent, or Firm*—Fitzpatrick, Cella, Harper & Scinto

(57) ABSTRACT

A liquid jet printing head includes a discharging outlet for discharging printing liquid, an energy generating element capable of generating an energy for discharging the liquid through the discharging outlet and a discharging outlet face at which the discharging outlet is arranged, characterized in that the discharging outlet face has a water repellent material layer with fine particles of an inorganic material distributed in a water repellent resin in a desired distribution state. A liquid jet printing apparatus is provided with the liquid jet printing head.
The liquid jet printing head enables one to always perform stable ink discharging thereby providing high quality printed images.

14 Claims, 9 Drawing Sheets

LIQUID JET PRINTING HEAD AND LIQUID JET PRINTING APPARATUS PROVIDED WITH SAID LIQUID JET PRINTING HEAD

This application is a continuation, of application Ser. No. 08/240,708, filed Sep. 1, 1994, now abandoned which is 371 of PCT/JP 93/01271 filed Sep. 8, 1993.

FIELD OF THE INVENTION

The present invention relates to an improvement in a liquid jet printing head for conducting recording by discharging and flying through a liquid discharging outlet recording liquid (usually, ink) to form a liquid droplet, resulting in depositing on the surface of a recording material (in the following, this liquid jet printing head also may be called a "liquid jet recording head"). More particularly, the present invention relates to an improved liquid jet printing head in which a peripheral area of the discharging outlets has a specific surface treatment applied thereto.

The present invention also relates to a liquid jet printing apparatus provided with the improved liquid jet printing head. Further, the present invention includes a process for producing the improved liquid jet printing head.

RELATED BACKGROUND ART

Of the presently known various printing systems, the ink jet printing system has been evaluated as a very effective non-impact printing system in that printing can be conducted at a high speed while substantially not causing noise.

A typical ink jet printing head used in the ink jet printing system is of the configuration shown in FIG. 2.

In FIG. 2, reference numeral 1 indicates a substrate for an ink jet printing head. The substrate is constituted by a glass, aluminum or silicon material. Reference numeral 4 indicates liquid pathways formed by joining the substrate 1 to a top plate 2 provided with a plurality of grooves which define liquid pathways. In each of the liquid pathways 4, there is installed an energy generating element 3 for generating energy for discharging ink. Reference numeral 7 indicates a nozzle plate provided with a plurality of discharging outlets 7*a* each being communicated with the corresponding liquid pathway 4. The nozzle plate 7 is joined to the assembly comprising the substrate 1 and the top plate 2 to establish an ink jet printing head.

In the ink jet printing head thus configured, when printing is conducted by discharging ink droplets through the discharging outlets of the ink jet printing head, part of those ink droplets are sometimes dropped to deposit on the discharging outlet face at which the discharging outlets are arranged. There is a tendency that such an ink deposit on the discharging outlet face comes to contact with ink droplets successively discharged from the discharging outlets, causing the flying direction of the ink droplets discharged to be deviated, and or the ink deposit causes a load to the ink droplets discharged and so reduces their discharge speed. These phenomena are apparently found in the case where the ink discharging is conducted at high frequency. And, in the case of the high speed printing system in which ink discharging is conducted at a frequency of 10,000 or more times per second, the occurrence of these phenomena causes serious problems such that not only the ink discharging direction but also the ink discharging speed are varied and in addition to this, in the worst case, the foregoing ink deposits on the discharging outlet face sometimes plug up the discharging outlets to prevent ink droplets from being discharged from the discharging outlets.

In order to prevent these problems from occurring, there is a proposal of applying a water repellent treatment at peripheral portions of the arrangement of the discharging outlets of the ink jet printing head. In the case of subjecting the peripheral portions of the arrangement of the discharging outlets to water repellent treatment in accordance with this proposal, it is possible to prevent ink deposition from occurring at the peripheral portions of the arrangement of the discharging outlets so that the foregoing problems can be solved, to some extent. It is known that the water repellent treatment herein is desired to be conducted for the discharging outlet face only. The reason for this is due to the fact that in the case where the water repellent treatment is applied on portions other than the discharging outlet face, particularly, the liquid pathways, a reduction is caused in the capillary action effected for the ink supply in the liquid pathways to diminish the ink supply efficiency.

The above water repellent treatment to the discharging outlet face is usually conducted so that a distinct contrast is established between the discharging outlet face and the liquid pathway inner walls, in order to enable stable discharging for the discharging outlets.

Now, the discharging outlet face thus applied with the water repellent treatment desirably exhibits its water-repellent property in the earlier printing operations of the ink jet printing head, but as the ink jet printing head is repeatedly used, the water repellent material applied on the discharging outlet face is gradually oxidized by air or ink or is sometimes partially peeled off by the action of ink effused whereby the discharging outlet face is deteriorated in terms of the water-repellent property. In view of this, in the water repellent treatment of the discharging outlet face, it is necessary to have due care for the chemical stability and adhesion properties of the water repellent material applied.

Incidentally, even in the case where the discharging outlet face applied with the foregoing water repellent treatment is satisfactory in terms of the ink-repellent property, ink droplets are sometimes deposited thereon. These ink droplets deposited on the discharging outlet face are only slightly removed unless they are removed by way of an external force, specifically, by applying an external vibration so as to remove them or by wiping them off using a mechanical means. In the case where such ink droplets remain on the discharging outlet face without being removed, they collect and grow in size, forming large-sized ink droplets, wherein problems arise in that the discharging outlets are hindered by those large-sized ink droplets in terms of the ink discharging performance, the direction of ink discharged from the discharging outlets is deflected due to those large-sized ink droplets, or some of the discharging outlets are liable to be defective in terms of the ink discharging performance due to those large-sized ink droplets. In order to prevent these problems from occurring, the ink jet printing apparatus is usually provided with a wiping mechanism comprising a cleaning blade which serves to wipe the discharging outlet face in terms of conducting the recovery treatment for the ink jet printing head.

In general, such a recovery treatment mechanism in the ink jet printing apparatus comprises, in addition to the above wiping mechanism, a suction recovery mechanism including a pump or the like for removing an ink residue having an increased viscosity in the nozzle portions.

However, in order to comply with a demand for miniaturization of the ink jet printing head in recent years, the suction recovery mechanism is occasionally omitted. In the case of an ink jet printing apparatus with no suction recovery mechanism, an ink residue having an increased viscosity is often left in the vicinity of the arrangement of the discharging outlets without being removed. In order to remove such highly viscous ink residue, the wiping operation by means of the foregoing wiping mechanism has to be conducted while press-contacting the cleaning blade against the peripheral portions of the discharging outlets at a higher cleaning blade contact pressure than that employed in the case of the ordinary ink jet printing apparatus. In this case where the cleaning blade contact pressure is raised, there now may arise a problem such that the discharging outlet face applied with the water repellent treatment, i.e., the water repellent discharging outlet face, is gradually worn due to the press contact of the cleaning blade at an increased contact pressure upon conducting the wiping operation to deteriorate in terms of the water-repellent effect, making the ink discharging performance unstable. In this case, in addition to this problem, a further problem arises. That is, when either the water repellent discharging outlet face of the ink jet printing head or the cleaning blade accumulates foreign matter, there is a tendency for the water repellent discharging outlet face to be readily damaged due to the foreign matter upon conducting the wiping operation while press-contacting the cleaning blade against the discharging outlet face. Other than these problems, there is also a problem in that when trouble occurs in the transportation of a printing member such as a paper, the water repellent discharging outlet face is liable to be worn with such printing member, making the water repellent discharging outlet defective in terms of the water-repellent effect. In order for the water repellent discharging outlet face to be free of the above problems, it is required to be more sufficient in terms of the abrasion resistance than that required in the case of the ordinary ink jet printing apparatus.

Now, as above described, in the case of the high speed printing system in which ink discharging is conducted at a frequency of 10,000 or more times per second, the amount of ink discharged per unit period of time is relatively great and because of this, the opportunity for ink to be deposited on the peripheries of the discharging outlets of the ink jet printing head used is increased accordingly. In order to prevent the occurrence of problems caused by such ink deposits, it is necessary to conduct frequently the wiping operation using the cleaning blade for the ink jet printing head at a relatively shortened interval. In this respect, even in the case of the high speed printing system, it is required for the discharging outlet face of the ink jet printing head used to be sufficient enough in terms of the abrasion resistance.

Incidentally, Japanese Patent Laid-open application No. 211956/1992 discloses a technique of treating a discharging outlet face of an ink jet recording head so as to have a water-repellent property using a water repellent material comprising a polymer having a fluorine heterocyclic structure in the principal chain, in order to improve the discharging outlet face in terms of the abrasion resistance. However, the water repellent material used in this technique is not sufficient enough in terms of providing a satisfactory abrasion resistance to the discharging outlet face although it is sufficient in terms of providing a desirable water-repellent property thereto. Particularly, in the case of the foregoing ink jet printing apparatus in which the suction recovery mechanism is omitted and which requires the wiping operation to be conducted by press-contacting the cleaning blade against the discharging outlet face at an increased contact pressure, even if the discharging outlet face should be treated using the water repellent material, the discharging outlet face applied with the water repellent treatment is still insufficient in terms of the abrasion resistance, wherein the foregoing problems cannot be eliminated as desired.

SUMMARY OF THE INVENTION

The present invention makes it a principal object to eliminate the foregoing problems in the prior art and to provide an improved liquid jet printing head.

Another object of the present invention is to provide a liquid jet printing head having an improved discharging outlet face which enables the effective removal of deposited materials including ink droplets deposited on the discharging outlet face during the printing operation without damaging the discharging outlet face even in the case where the suction recovery mechanism is omitted in order to comply with the foregoing demand for the miniaturization of an ink jet printing apparatus and which enables continuous performance of stable ink discharging whereby providing high quality printed images.

A further object of the present invention is to provide an improved liquid jet printing head which the continuous and stabe performance of high speed printing by conducting ink discharging at a frequency of 10,000 or more times per second and which enables the effective removal of deposited materials including ink droplets deposited on the discharging outlet face during the printing operation without damaging the discharging outlet face so that ink discharging is stably and continuously performed in a desirable state, wherein high quality printed images are continuously provided.

A further object of the present invention is to provide an improved liquid jet printing head with a discharging outlet face having a water repellent material layer comprised of a water repellent resin composition comprising a water repellent resin containing inorganic fine particles distributed therein in a desired distribution state which enables the effective removal of deposited materials including ink droplets deposited on the discharging outlet face during the printing operation without damaging the discharging outlet face so that ink discharging is stably and continuously performed in a desirable state, wherein high quality printed images are continuously provided.

A further object of the present invention is to provide an improved liquid jet printing head with a discharging outlet face having a water repellent material layer comprised of a water repellent resin composition comprising a water repellent resin containing inorganic fine particles distributed therein in a desired distribution state and wherein some of the inorganic fine particles are spacedly projected at the surface of the water repellent material layer, the liquid jet printing head enabling the effective removal of deposited materials including ink droplets deposited on the discharging outlet face during the printing operation without damaging the discharging outlet face so that ink discharging is stably and continuously performed in a desirable state, wherein high quality printed images are continuously provided.

A further object of the present invention is to provide a liquid jet printing apparatus provided with the aforesaid liquid jet printing head.

A further object of the present invention is to provide a process for producing the aforesaid liquid jet recording head.

The present invention has been accomplished as a result of extensive studies through experiments by the present inventors in order to eliminate the foregoing problems in the prior art and in order to attain the above objects.

The present inventors made extensive studies through the later described experiments, principally in view of the technique described in the aforementioned Japanese Patent Laid-open application No. 211959/1992.

As a result, they obtained the following findings. That is, in the case where a layer comprised of a water repellent resin composition comprising a water repellent resin containing fines particles of a hard material distributed therein in a desired distribution state such that each of the fine particles is tightly adhered with the water repellent resin is provided on the discharging outlet face of an ink jet printing head, the discharging outlet face is always ensured in terms of the abrasion resistance even in the case of an ink jet printing apparatus in which the foregoing suction recovery mechanism is omitted or even in the case of an ink jet printing head for high speed printing which performs ink discharging at a frequency of 10,000 or more times per second, wherein deposited materials, including ink droplets deposited on the discharging outlet face during the printing operation can be effectively removed without damaging the discharging outlet face so that ink discharging can be stably and continuously performed in a desirable state, wherein high quality printed images are continuously provided. The present invention has been accomplished based on these findings.

DESCRIPTION OF THE INVENTION AND THE PREFERRED EMBODIMENTS

Figure 1:
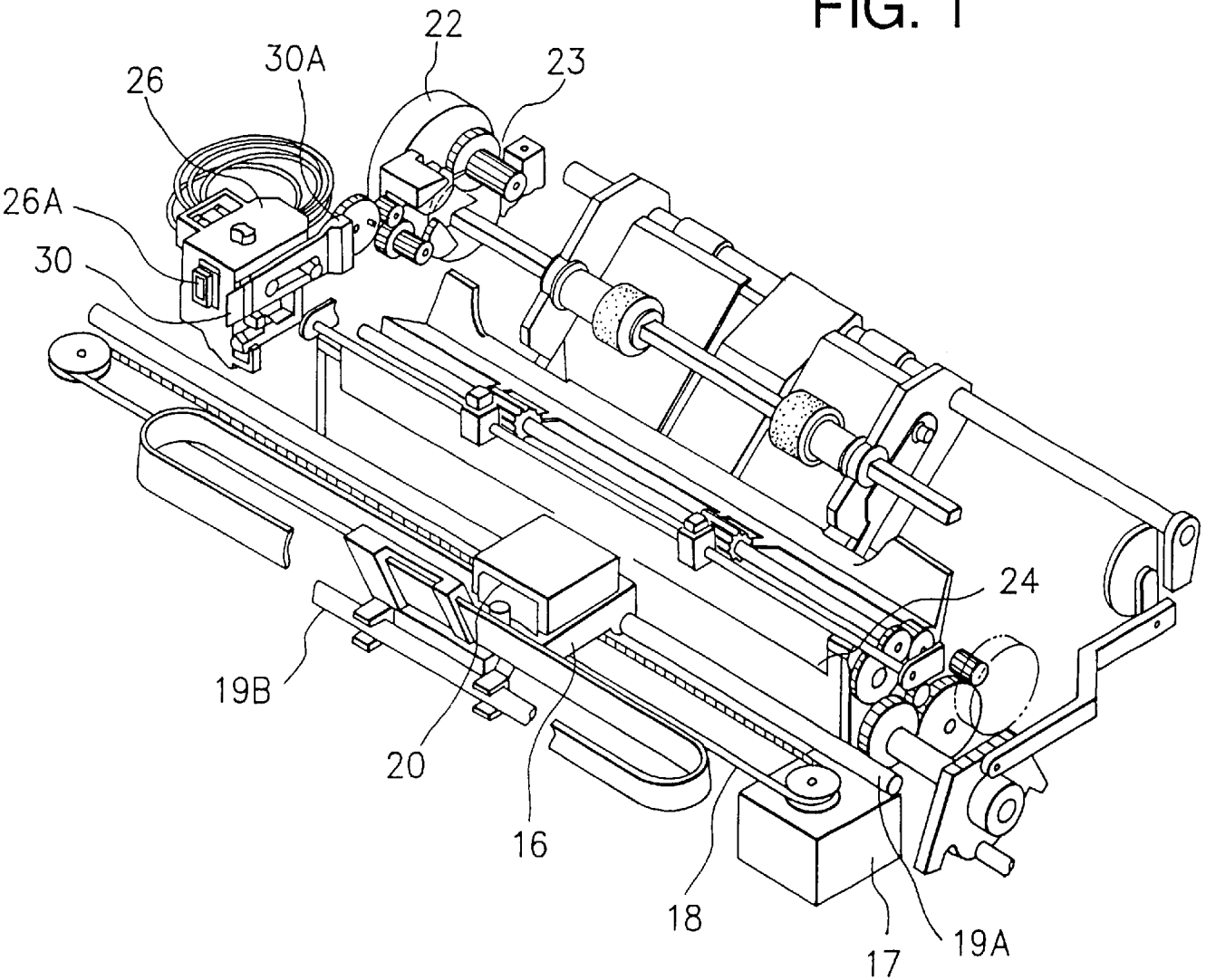
FIG. 1 is a schematic slant view illustrating the principal part of an embodiment of a liquid jet printing apparatus provided with a liquid jet printing head according to the present invention.

The present invention is applicable to printing heads used in the bubble jet system belonging to the on-demand type ink jet printing system (see, for example, U.S. Pat. Nos. 4,490,728 or 4,723,129), printing heads used in the piezo system belonging to the on-demand type ink jet printing system (see, for example, U.S. Pat. Nos. 3,683,212 or 3,946,398), printing heads used in the continuous type ink jet printing printing system, and printing heads used in the electrostatic suction type ink jet printing system. In any case wherein the present invention is applied, the discharging outlet face of the ink jet printing head is provided with a plurality of discharging outlets arranged therein and it is designed to have (a) a water repellent material layer comprised of a water repellent resin composition comprising a water repellent resin containing inorganic fine particles distributed therein in a desired distribution state or (b) a water repellent material layer comprised of a water repellent resin composition comprising a water repellent resin containing inorganic fine particles distributed therein in a desired distribution state and wherein some of the inorganic fine particles are spacedly protruded at the surface of the water repellent material layer. By this, deposit materials including ink droplets deposited on the discharging outlet face during the printing operation can be effectively removed without damaging the discharging outlet face so that ink discharging is stably and continuously performed in a desirable state, wherein high quality printed images are continuously provided.

The present invention provides an improved liquid jet printing head which is effectively usable not only in the case wherein the suction recovery mechanism is omitted but also in the case of conducting high speed printing while performing ink discharging at a frequency of 10,000 or more times per second, and a liquid jet printing apparatus provided with the liquid jet printing head.

The liquid jet printing head according to the present invention includes a discharging outlet for discharging recording liquid, an energy generating element capable of generating energy for discharging the recording liquid through the discharging outlet and a discharging outlet face at which the discharging outlet is arranged, wherein the discharging outlet face has (a) a water repellent material layer comprised of a water repellent resin composition comprising a water repellent resin containing inorganic fine particles distributed therein in a desired distribution state or (b) a water repellent material layer comprised of a water repellent resin composition comprising a water repellent resin containing inorganic fine particles distributed therein in a desired distribution state and wherein some of the inorganic fine particles are spacedly protruded at the surface of the water repellent material layer.

The liquid jet printing apparatus according to the present invention comprises a liquid jet printing head including a discharging outlet for discharging recording liquid, an energy generating element capable of generating energy for discharging the recording liquid through the discharging outlet and a discharging outlet face at which the discharging outlet is arranged, wherein the discharging outlet face has (a) a water repellent material layer comprised of a water repellent resin composition comprising a water repellent resin containing inorganic fine particles distributed therein in a desired distribution state or (b) a water repellent material layer comprised of a water repellent resin composition comprising a water repellent resin containing inorganic fine particles distributed therein in a desired distribution state and wherein some of the inorganic fine particles are spacedly protruded at the surface of the water repellent material layer.

The liquid jet printing head according to the present invention includes the following two head embodiments.

First Head Embodiment

A liquid jet printing head including a discharging outlet for discharging liquid; a substrate for a liquid jet printing head including an electrothermal converting body comprising a heat generating resistor capable of generating a thermal energy for discharging liquid from the discharging outlet and a pair of wirings electrically connected to the heat generating resistor, the pair of wirings being capable of supplying an electric signal for generating the thermal energy to the heat generating resistor; and a liquid supplying pathway disposed in the vicinity of the electrothermal converting body of the substrate, wherein the discharging outlet is disposed at a discharging outlet face, characterized in that the discharging outlet face is provided with a water repellent material layer comprised of a water repellent resin composition comprising a water repellent resin containing inorganic fine particles distributed therein in a desired distribution state.

The liquid jet printing head according to this first head embodiment enables the effective removal of deposited materials including ink droplets deposited on the discharging outlet face during the printing operation without damaging the discharging outlet face so that ink discharging can be stably and continuously performed in a desirable state, wherein high quality printed images are continuously provided.

Second Head Embodiment

A liquid jet printing head including a discharging outlet for discharging liquid; a substrate for a liquid jet printing head including an electrothermal converting body comprising a heat generating resistor capable of generating thermal energy for discharging liquid from the discharging outlet and a pair of wirings electrically connected to the heat generating resistor, the pair of wirings being capable of supplying an electric signal for generating the thermal energy to the heat generating resistor; and a liquid supplying pathway disposed in the vicinity of the electrothermal converting body of the substrate, wherein the discharging outlet is disposed at a discharging outlet face, characterized in that the discharging outlet face is provided with a water repellent material layer comprised of a water repellent resin composition comprising a water repellent resin containing inorganic fine particles distributed therein in a desired distribution state and wherein some of the inorganic fine particles are spacedly protruded at the surface of the water repellent material layer.

The liquid jet printing head according to this second head embodiment also enables the effective removal of deposited materials including ink droplets deposited on the discharging outlet face during the printing operation without damaging the discharging outlet face so that ink discharging can be stably and continuously performed in a desirable state, wherein high quality printed images are continuously provided.

The liquid jet printing apparatus according to the present invention includes the following two apparatus embodiments.

First Apparatus Embodiment

A liquid jet printing apparatus comprising: (a) a liquid jet printing head including a discharging outlet for discharging liquid, a substrate for a liquid jet printing head including an electrothermal converting body comprising a heat generating resistor capable of generating a thermal energy for discharging liquid from the discharging outlet and a pair of wirings electrically connected to the heat generating resistor, the pair of wirings being capable of supplying an electric signal for generating the thermal energy to the heat generating resistor, and a liquid supplying pathway disposed in the vicinity of the electrothermal converting body of the substrate, wherein the discharging outlet is disposed at a discharging outlet face; and (b) an electric signal supplying means capable of supplying an electric signal to the heat generating resistor of the printing head, characterized in that the discharging outlet face of the printing head is provided with a water repellent material layer comprised of a water repellent resin composition comprising a water repellent resin containing inorganic fine particles distributed therein in a desired distribution state.

The liquid jet printing apparatus according to this first apparatus embodiment enables the effective removal of deposited materials including ink droplets deposited on the discharging outlet face during the printing operation without damaging the discharging outlet face of the printing head so that ink discharging can be stably and continuously performed in a desirable state, wherein high quality printed images are continuously provided.

Second Apparatus Embodiment

A liquid jet printing apparatus comprising: (a) a liquid jet printing head including a discharging outlet for discharging liquid, a substrate for a liquid jet printing head including an electrothermal converting body comprising a heat generating resistor capable of generating a thermal energy for discharging liquid from the discharging outlet and a pair of wirings electrically connected to the heat generating resistor, the pair of wirings being capable of supplying an electric signal for generating the thermal energy to the heat generating resistor, and a liquid supplying pathway disposed in the vicinity of the electrothermal converting body of the substrate, wherein the discharging outlet is disposed at a discharging outlet face; and (b) an electric signal supplying means capable of supplying an electric signal to the heat generating resistor of the printing head, characterized in that the discharging outlet face of the printing head is provided with a water repellent material layer comprised of a water repellent resin composition comprising a water repellent resin containing inorganic fine particles distributed therein in a desired distribution state and wherein some of the inorganic fine particles are spacedly protruded at the surface of the water repellent material layer.

The liquid jet printing apparatus according to this second apparatus embodiment also enables the effective removal of deposited materials including ink droplets deposited on the discharging outlet face during the printing operation without damaging the discharging outlet face so that ink discharging can be stably and continuously performed in a desirable state, wherein high quality printed images are continuously provided.

In the following, description will be made of the liquid jet printing head (particularly, the ink jet printing head) and the process for the production thereof according to the present invention.

Figure 2:
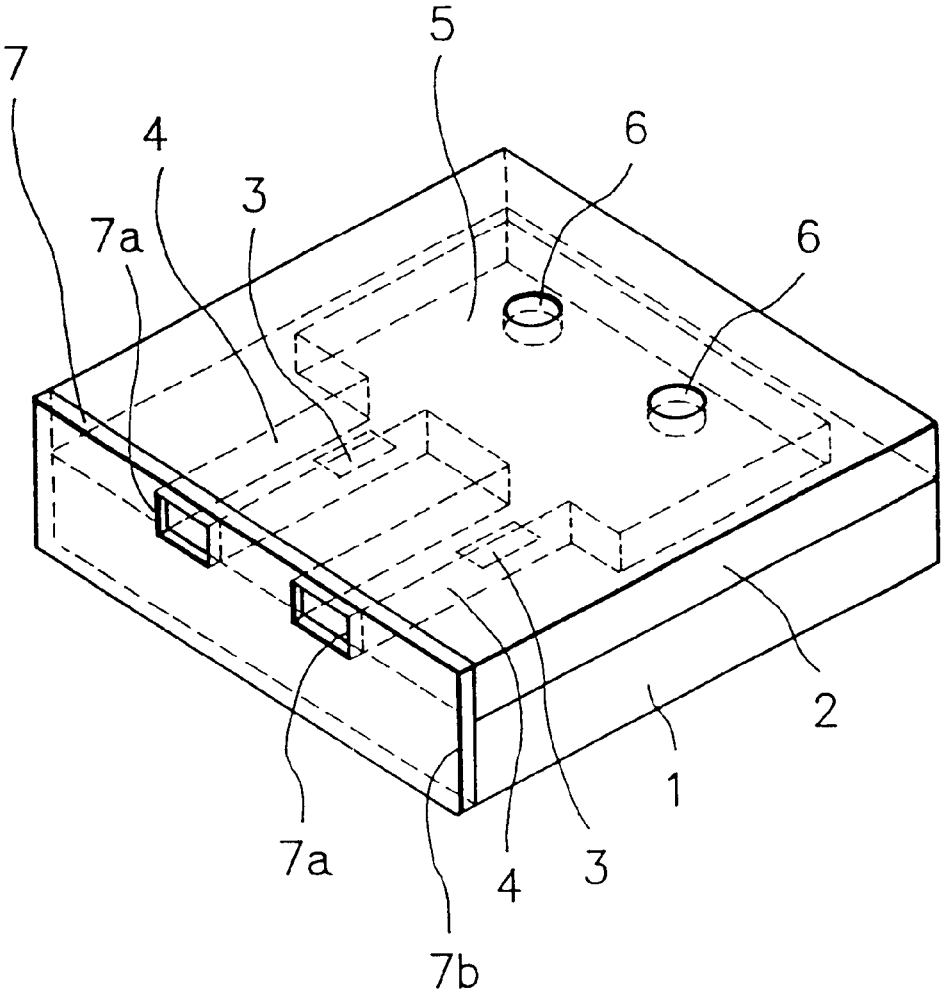
FIG. 2 is a schematic view illustrating the principal part of an embodiment of a liquid jet printing head according to the present invention.

The liquid jet printing head according to the present invention is typically of the configuration shown in FIG. 2. In FIG. 2, reference numeral 1 indicates a base member, reference numeral 2 a structural member, reference numeral 3 an electrothermal converting body, reference numeral 4 a liquid pathway, reference numeral 5 a liquid chamber, reference numeral 6 a supply port, reference numeral 7 a discharging outlet plate (or a nozzle plate), reference numeral 7*a* a discharging outlet, and 7*b* a discharging outlet face.

The liquid jet printing head according to the present invention may be produced in the following manner.

Figure 3:
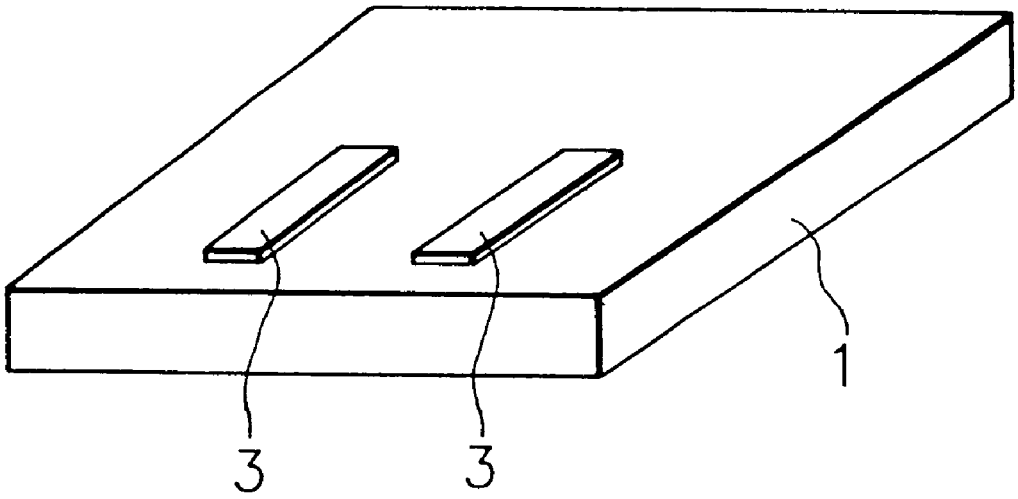
FIG. 3 is a schematic explanatory view of the step of forming electrothermal converting bodies on a base member in the production of a liquid jet printing head according to the present invention.

Firstly, as shown in FIG. 3, on the base member 1 comprising a member made of glass, ceramic or plastic, there are formed two electrothermal converting bodies 3 each having an aluminum electrode in accordance with the conventional semiconductor-producing technique using etching, vacuum deposition or sputtering process. In FIG. 3, the number of the electrothermal converting bodies (that is, the energy generating elements) is intentionally made to be only two for the simplification purpose. In practice, this number is made to be an appropriate number which is greater than two. Thus, it should be understood that the following description of the case when the number of the electrothermal converting bodies (the energy generating elements) is directed to, but not limiated to, two. Similarly, it should be also understood that the number of each of the liquid pathways and discharging outlets corresponding to the electrothermal converting bodies is not limited to two but is made to be more than two in practice. Principally, aiming at improving the durability, there is provided an appropriate functional layer such as a protective layer not only for the aluminum electrodes and electrothermal converting bodies but also for other constituents depending upon the necessity. The present invention is effective, notwithstanding the constituent material of such functional layer or whether such functional layer is present or not present.

Figure 4:
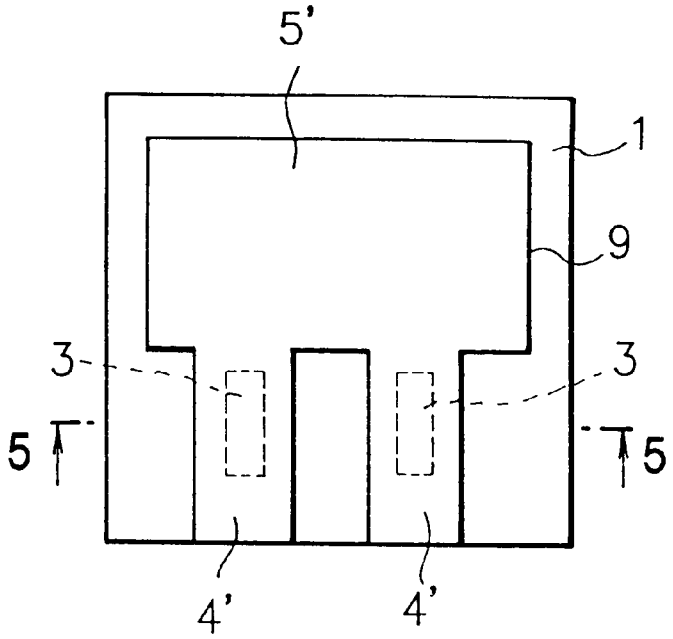
FIG. 4 is a schematic explanatory view of the step of forming a solid layer at positions where liquid pathways and a liquid chamber are to be formed in the production of a liquid jet printing head according to the present invention.
Figure 5:
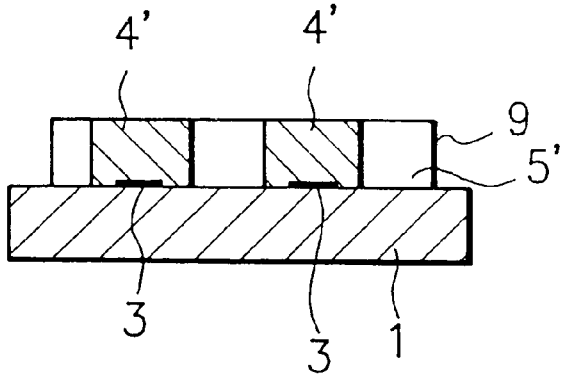
FIG. 5 is a schematic cross-sectional view, taken along line 5—5 in FIG. 4.

Then, as shown in FIGS. 4 and 5, a solid layer 9 is laminated on the base member 1 such that it covers portions 4' where liquid pathways are to be formed and a portion 5 where a liquid chamber is to be formed while covering the electrothermal converting bodies 3. The solid layer 9 thus formed is partially removed in the later-described manner so that liquid pathways 4 (see, FIG. 2) and a liquid chamber 5 (see, FIG. 2) can be formed respectively at the corresponding portion where the solid layer is removed. Not only the liquid pathways 4 but also the liquid chamber may be configured as desired. It is possible for the solid layer 9 to be configured so as to correspond to the liquid pathways 4 and the liquid chamber 5.

In this embodiment, two discharging outlets 7*a* (see, FIG. 2) are provided such that each of them corresponds to one of the two electrothermal converting bodies 3. And the liquid pathways 4 are communicated with the liquid chamber 5 so that ink can be discharged through each of the discharging outlets.

Not only the solid layer 9 but also the liquid pathways 4 and the liquid chamber 5 may be desirably formed by means of the photolithography technique. In this case, for instance, a positive or negative type photosensitive dry film is laminated on the surface of the base member 1, the resultant is exposed using a patterning mask for forming the liquid pathways 4 and the liquid chamber 5, followed by development, whereby a solid layer 9 with patterns for the liquid pathways 4 and the liquid chamber 5 is formed. As the photosensitive dry film used herein, any photosensitive dry film may be used as long as it is readily resolved in an appropriate solvent and can be desirably removed in the removing step which will be later described. The use of a positive type photosensitive dry film is more advantageous in comparison with the case of using a negative type photosensitive dry film, for the reason that the former makes it possible to form the solid layer 9 so as to have a cross section substantially in the form of a rectangular shape.

The above photolithography technique may be replaced by the screen printing technique or other appropriate printing technique such as intaglio printing technique in which an intaglio plate obtained by etching a metal plate of Ni or Cu is used, wherein the solid layer 9 having a desired pattern may be formed with a desired thickness. The constituent material of the solid layer 9 which is formed by these printing techniques can include water-soluble polyvinyl alcohol resins, and other than these, solvent-soluble vinyl chloride resins, vinyl acetate resins, vinyl chloride-vinyl acetate copolymers, and styrene resins.

Figure 6:
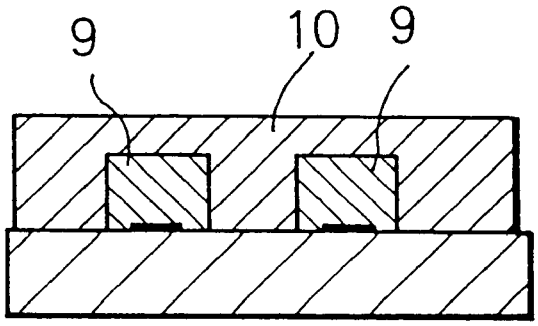
FIG. 6 is a schematic explanatory view of the step of forming a hardening material layer on the solid layer and hardening the hardening material layer in the production of a liquid jet printing head according to the present invention.

After the solid layer 9 has been formed on the surface of the base member 1 in the foregoing manner, a layer 10 comprising a hardening material is formed to cover the solid layer 9, and the layer 10 is completely hardened, as shown in FIG. 6. The layer 10 becomes the structural member 2 (that is, the top plate) shown in FIG. 2 when it is completely hardened. The hardening material by which the layer 10 is constituted can include any hardening materials as long as they can form a layer which covers the solid layer 10. However, the layer comprised of the hardened material eventually becomes a structural member of an ink jet printing head while serving to form the liquid pathways 4 and the liquid chamber 5 and because of this, the hardening material used is preferably selected to excel not only in adhesion with the base member 1 but also in mechanical strength, dimensional stability, and corrosion resistance. Specific examples of such hardening material capable of satisfying these requirements are hardening materials which can be hardened with irradiation of rays of an activation energy such as ultraviolet rays or electron beams and other hardening materials each comprising a principal material and a hardener which can be hardened when the hardener is mixed with the principal material.

The formation of the layer 10 may be conducted by using an ejection instrument provided with a nozzle corresponding to the shape of the base member, applicator, curtain coater, roll coater, spray coater, or spin coater. Upon forming the layer 10 by applying a hardening material in the liquid state, it is desired to conduct the application of the liquid hardening material while deaerating the liquid hardening material to prevent air bubbles from getting into the layer formed.

Thus, there is obtained a stacked body comprising the solid layer 9 and the layer 10 comprised of the hardening material being formed in this order on the base member 1.

Herein, in the case where the portions serving to form the liquid pathways 4 do not have exposed end portions, it is possible to cut the stacked body through a desired portion thereof, for example, by a dicing saw means using a diamond blade to expose thereby the corresponding end portions of the portions serving to form the liquid pathways 4. This operation is, however, not always necessary. That is, it is also possible to take such a manner that upon forming the layer 10 using a liquid hardening material, the application of the liquid hardening material is conducted using an appropriate die to thereby form the portions serving to form the liquid pathways 4 having exposed end portions shaped in a desired form.

Figure 7:
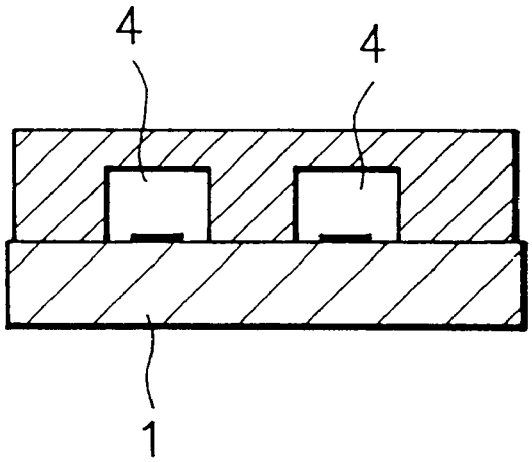
FIG. 7 is a schematic explanatory view of the step of removing the solid layer from a stacked body obtained in the above in the production of a liquid jet printing head according to the present invention.

After the above step, as shown in FIG. 7, the solid layer 9 is partially removed from the stacked body obtained as above to thereby form liquid pathways 4 and a liquid chamber (not shown in the figure). The partial removal of the solid layer 9 in this case may be conducted by a conventional layer-removing technique. As a preferred embodiment of conducting this removal step, there can be mentioned a manner of partially removing the solid layer 9 by using a liquid capable of resolving, swelling or releasing it. In this manner, it is possible to employ an appropriate removal-promoting technique using an appropriate treatment including ultrasonic vibration, spraying, heating, stirring, shaking, or pressure recycling treatments.

Specific examples of the liquid used in the above layer-removing step are halogen-containing hydrocarbons, ketones, esters, aromatic hydrocarbons, ethers, alcohols, N-methylpyrrolidone, dimethylformamide, phenols, water, and aqueous solutions containing acids or alkalis. These liquids may contain surfactants, if necessary.

In view of facilitating the layer removal, it is desired to irradiate ultraviolet rays on the solid layer in the case where the solid layer is constituted by a positive type dry film. In the case where the solid layer is constituted by other material, it is desired to heat the foregoing liquid at a temperature of 40 to 60° C.

Figure 8:
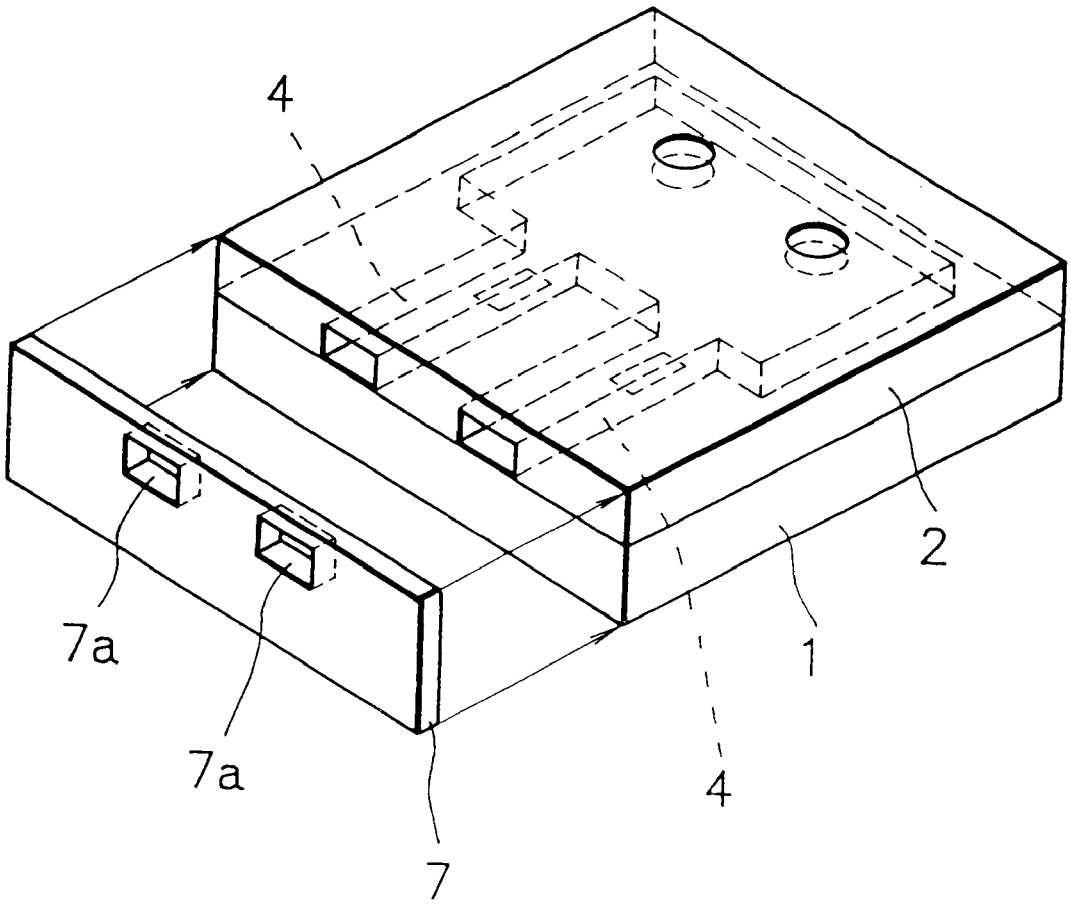
FIG. 8 is a schematic explanatory view of the step of joining a nozzle plate to a stacked body obtained as a result of the removal of the solid layer in the production of a liquid jet printing head according to the present invention.

After the above respective steps having been completed, as shown in FIG. 8, a nozzle plate 7 having discharging outlets 7*a* formed by using an excimer laser or the like is provided. Each of the discharging outlets of the nozzle plate is designed to correspond to one of the liquid pathways 4. The nozzle plate 7 is assembled to the stacked body which comprises the base member 1 and the structural member 2 comprising the hardened material 10 (see, FIG. 6) such that the discharging outlets 7*a* of the nozzle plate are joined to the exposed portions of the liquid pathways 4 and that the discharging outlets 7*a* are communicated with the liquid pathways 4. In this way a liquid jet printing head (an ink jet printing head in other words) is completed.

In this embodiment, the formation of nozzles is conducted by fixing the nozzle plate to the surface of the stacked body. But, it is possible to take a manner in which the exposed liquid pathway faces (the exposed liquid pathway cut faces in other words) themselves are used as nozzles.

Further, in an alternative, an ink jet printing head can be obtained by providing a top plate (that is, a grooved plate) comprising a nozzle plate and grooves serving to form liquid pathways obtained by way of the injection molding technique and joining the top plate to a substrate of the configuration shown in FIG. 3 which is provided with electrothermal converting bodies. In this case, since the grooved plate is formed by molding, even in the case where it is constituted by a single constituent material, the constituent material is required to be selected with due care about the moldability and the contactability against ink. Specific examples of the useful materials in this case are polysulfone, polyethersulfone polyester, and polyacetal.

In the present invention, the discharging outlets-bearing face, i.e., the discharging outlet face of the ink jet printing head thus obtained has applied thereto the water repellent treatment.

In the following, description will be made of the feature of the present invention of applying the water repellent treatment to the discharging outlet face. In the present invention, the discharging outlets-bearing face, i.e., the discharging outlet face of the ink jet printing head thus obtained has applied thereto the water repellent treatment.

In the following, description will be made of the feature of the present invention of applying the water repellent treatment to the discharging outlet face.

The water repellent treatment to the discharging outlet face in the present invention can be attained by using a combination of a specific material exhibiting excellent water-repellent effects and a specific material exhibiting excellent abrasion resistance. Particularly, the combination comprises hard fine particles of a specific hard material dispersed in a liquid of a specific water repellency agent. The use of this combination upon the water repellent treatment of the discharging outlet face concurrently exhibits the water-repellent effect possessed by the water repellency agent and the abrasion resistance possessed by the hard fine particles.

Specific examples of such water repellency agents are fluoroolefin-vinyl ether alternating copolymers, i.e., fluoroethylene vinyl ethers (FEVEs) such as LUMIFLON (trademark name, produced by Asahi Glass Co., Ltd.), FLUONATE (trademark name, produced by DIC Company), SEFRALCOAT (trademark name, produced by Central Glass Co., Ltd.), C-1 (trademark name, produced by Daikin Glass Co., Ltd.), TRIFLON (trademark name, produced by Mitsuisekika Glass Co., Ltd.), and KYNAR-SL/KNAR-ADS (trademark name, produced by ATOCHEM Company); photoradical polymerization type fluorine-contained resins comprising reactive oligomers and diluent monomers such as DEFENSA (trademark name, produced by Dainippon Ink and Chemicals Incorporated); copolymerization type fluorine-contained polymers such as LF-40 (trademark name, produced by Sokenkagaku Kabushiki Kaisha); fluorosilicons such as KP801M (trademark name, produced by Shin-Etsu Chemical Co., Ltd.); and perfluorocyclopolymers such as CYTOP (trademark name, produced by Asahi Glass Co., Ltd.) and Teflon AF (trademark name, produced by Du Pont Company). Other than these, there can be used other commercially available appropriate materials which exhibit satisfactory adhesion properties to the nozzle plate.

Any of the above-mentioned water repellency agents may be either in the liquid state or in the gel state. Of course, any of the water repellency agents used desirably has a viscosity capable of allowing the hard material fine particles to be uniformly dispersed therein and maintaining the dispersed state.

For the hard fine particles used in the present invention, there is an upper limit in terms of the particle size because the discharging outlets of a liquid jet printing head are designed to be of micron size.

Having due care about this situation, the hard fine particles are generally made to be preferably of a mean particle size of 1 $\mu$m or less, more preferably of a mean particle size of 0.5 $\mu$m or less.

In addition to this, the hard fine particles used in the present invention are required to be chemically stable. And as for the hard material from which the hard fine particles are obtained, it is required to be readily pulverized. In view of this, it is desired to use hard fine particles of an inorganic hard material. Specific examples of the inorganic hard material are silica, alumina, magnesium carbonate, and magnesia. Other than these, it is possible to use other inorganic materials as long as their particles possess properties including hardness which are applicable to the peripheries of the discharging outlets of an ink jet printing head.

In any case, the hard fine particles of the above described inorganic material (hereinafter referred to as inorganic hard fine particles) are dispersed in the water repellency agent on the discharging outlet face such that the inorganic hard fine particles are uniformly dispersed in the peripheral portions of the discharging outlets arranged in the discharging outlets.

The present inventors made experimental studies of the dispersion state of the inorganic hard fine particles in the water repellency agent on the discharging outlet face of an ink jet printing head. As a result, there was obtained a desirable dispersion density which enables one to attain the object of the present invention. Particularly, there was obtained the following finding. That is, in the case where the inorganic hard fine particles are controlled in terms of the dispersion density such that they are dispersed to provide irregularities at the surface of the discharging outlet face wherein an ink droplet can be supported by three or more protrusions caused by the inorganic hard fine particles, when ink droplets generated upon the ink discharging from the discharging outlets should be deposited on the irregular surface of the discharging outlet face, the recesses of the irregular surface sustain air and because of this, those ink droplets do not stay on the discharging outlet face but readily drop therefrom.

The present invention has been accomplished based on this finding.

Description will be made of the manner of conducting the water repellent treatment for the discharging outlet face in the present invention.

The dispersion of inorganic hard fine particles into a liquid water repellency agent can be conducted by means of a ball mill or sand mill. However, this can be also done by means of a homogenizer, which is less expensive in terms of the apparatus cost.

The dispersion of inorganic hard fine particles into the water repellency agent can be attained in the same manner as in the ordinary case of dispersing given fine particles into a liquid material. Specifically, for instance, a given amount of the water repellency agent (specifically, water repellent resin) is resolved in an appropriate solvent to obtain a liquid having a viscosity allowing the inorganic hard fine particles to be desirably dispersed therein. The liquid thus obtained is introduced into the foregoing dispersing apparatus. A given amount of the inorganic hard fine particles is introduced thereinto. Then, the two materials introduced into the dispersing apparatus are well mixed while stirring to thereby obtain a dispersion comprising the inorganic fine particles dispersed in the liquid water repellency agent in a desirable dispersion state.

The dispersion thus obtained is applied onto the surface of the discharging outlet face of an ink jet printing head. The manner of applying the dispersion in this case is different depending upon the manner employed upon the formation of the discharging outlets. The dispersion application technique can include transfer coating and ordinary coating. The former is employed in the case where the discharging outlets are formed prior to the water repellent treatment. The latter is employed in the case where the discharging outlets are formed after the water repellent treatment.

The transfer coating process can include a manner of applying the dispersion onto the surface of a flexible sheet made of rubber for example by means of a spin coater for example and contacting the face at which discharging outlets are formed to the dispersion applied on the flexible sheet to thereby transfer the dispersion to the face and a manner of transferring the dispersion to the face at which discharging outlets are formed by means of a flexo-printer (or an angstromer). In the case of forming the discharging outlets by way of an excimer laser after the water repellent treatment by way of the coating manner, the coating manner can include a dip coating step and a brushing step.

After the dispersion is applied as above described, the water repellency agent of the dispersion is subjected to fixing treatment. Particularly, the fixing treatment in this case is conducted by irradiating ultraviolet rays to the dispersion in the case where the water repellency agent comprises a water repellency agent which is hardened with the irradiation of ultraviolet rays, by heating the dispersion in the case where the water repellency agent comprises a water repellency agent which is hardened by heat energy, or by heating the dispersion in the case where the water repellency agent comprises a water repellency agent which is hardened when the solvent is volatilized.

Figure 10:
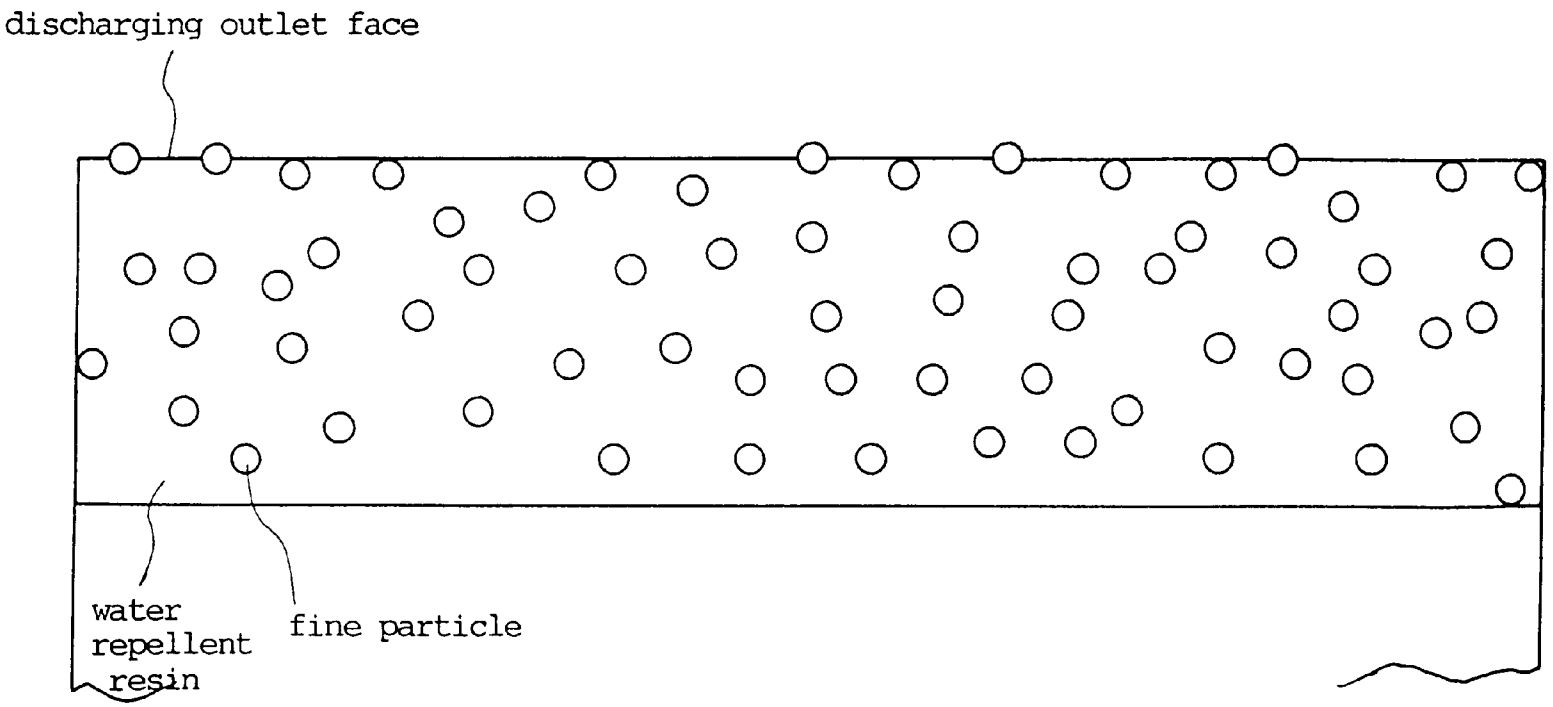
FIG. 10 is a schematic cross-sectional view illustrating an embodiment of a water repellent material layer according to the present invention.

In this way, there can be formed a layer applied with the water repellent treatment (hereinafter, this layer will be sometimes called water repellent material layer or water repellent treating layer) having such a configuration as shown in FIG. 10 for a liquid jet printing head.

Figure 11:
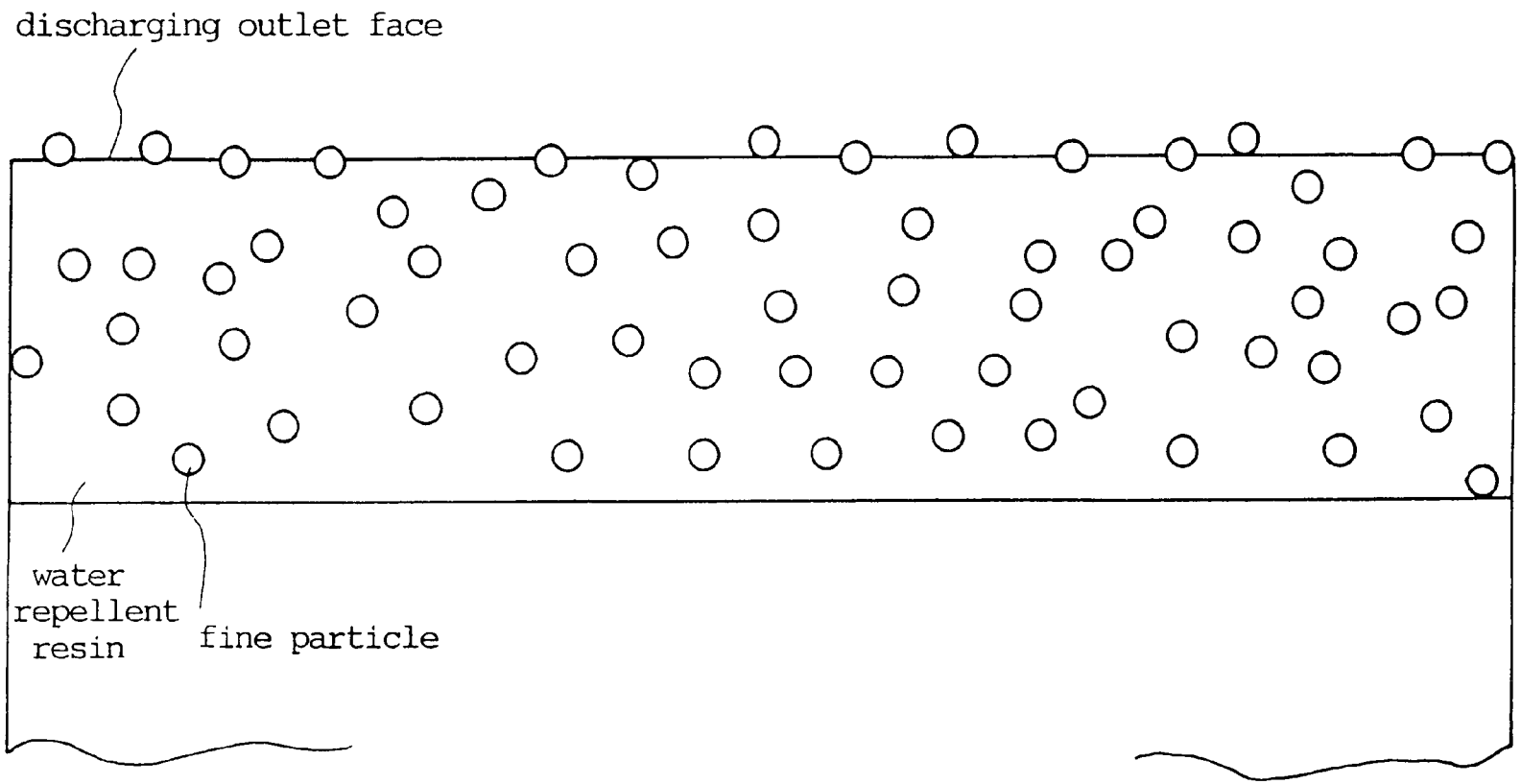
FIG. 11 is a schematic cross-sectional view illustrating a surface state of a water repellent material layer formed by partially resolving the surface region of the water repellent material layer shown in FIG. 10.

In the case of intentionally projecting some of the inorganic hard fine particles at the surface of the layer, the above fixing treatment is terminated before it is finalized, the layer is immersed in a solvent for the water repellency agent or in a solvent with which the water repellency agent can be resolved to partially resolve the layer, and the resultant is again subjected to the fixing treatment to completely fix the water repellency agent of the layer. By this, there is provided a water repellent material layer having a configuration as shown in FIG. 11 in which some of the inorganic hard fine particles are protruded at the surface of the layer at a desired protrusion density without hindering the dispersed state of the inorganic hard fine particles in the water repellency agent. The layer applied with the water repellent treatment having a plurality of intentional protrusions each comprising an inorganic hard fine particle at the surface provides an improvement in terms of the abrasion resistance and also in terms of the contact angle against ink.

EXPERIMENTS

In the following, experiments which were conducted by the present inventors will be described.

Experiment 1

The present inventors made extensive studies through experiments aimed at solving the problems occurring due to insufficient abrasion resistance in the case of an ink jet printing head described in the foregoing Japanese Patent Laid-open application No. 211959/1992 in which the discharging outlet face is provided with a water repellent layer comprising a polymer having a fluorine-containing heterocyclic structure in the principal chain, and establishing an improved water repellent layer for the ink jet printing head which is free of such problems in the prior art and which exhibits a sufficient water repellent effect and sufficient durability. That is, the present inventors made studies by dispersing fine particles of hard materials (that is, hard fine particles) into a given water repellent resin to obtain various water repellent material layers and examining these layer to see whether the water repellent material layers are effective or not in solving the problems in the prior art through the following Experiments 1-1 through 1-7. In the following Experiments 1-1 through 1-7, aiming at realizing a desirable water repellent layer for an ink jet printing head, discussions were made of the affinity between a given water repellent resin and given hard fine particles, the interrelation between the viscosity of the water repellent resin and the mean particle size of the hard fine particles, and the suitability of each of the layers formed to be used as the water repellent layer for the discharging outlet face of an ink jet printing head.

Experiment 1-1

Perfluorocyclic ether (trademark name: CTsolve 100, produced by Asahi Glass Co., Ltd.) was added to perfluorocyclopolymer (trademark name: CYTOP CT-805A, produced by Asahi Glass Co., Ltd.) to obtain a resin liquid having a viscosity of 20 cps. The resin liquid thus obtained was mixed with silica spherical fine particles of 0.1 $\mu$m in mean particle size (trademark name: ESQUARTZ H2001, produced by Shinnitetsu Kagaku Kabushiki Kaisha) in an amount corresponding to 1/10 part by weight of the resin liquid, to thereby obtain a mixture. The resultant mixture was introduced into a homogenizer, wherein the mixture was well homogenized to obtain a water repellent resin composition. There was then provided a plate made of thermoplastic resin polysulfone (trademark name: UDEL) for use in a grooved top plate for an ink jet cartridge (that is, a BJ Cartridge BC-01 produced by Canon Kabushiki Kaisha). The above water repellent resin composition was applied onto the surface of this plate in an amount to provide a 1 $\mu$m thick layer when dried in accordance with the coating manner, followed by subjecting the resultant to fixing treatment in a clean oven filled with nitrogen gas wherein it was dried at 100° C. for an hour, to thereby obtain a specimen comprising a water repellent material layer formed on the polysulfone plate.

Experiment 1-2

The procedures of Experiment 1-1 were repeated, except that the resin liquid was made to be of 100 cps in viscosity, to thereby obtain a specimen comprising a water repellent material layer formed on the surface of a polysulfone plate.

Experiment 1-3

The procedures of Experiment 1-1 were repeated, except that the silica spherical fine particles (trademark name: ESQUARTZ H-2001, produced by Shinnitetsu Kagaku Kabushiki Kaisha) were replaced by silica spherical fine particles of 0.8 $\mu$m in mean particle size (trademark name: ESQUARTZ H-2008, produced by Shinnitetsu Kagaku Kabushiki Kaisha), to thereby obtain a specimen comprising a water repellent material layer formed on the surface of a polysulfone plate.

Experiment 1-4

The procedures of Experiment 1-3 were repeated, except that the resin liquid was made to be of 100 cps in viscosity, to thereby obtain a specimen comprising a water repellent material layer formed on the surface of a polysulfone plate.

Experiment 1-5

The procedures of Experiment 1-1 were repeated, except that the silica spherical fine particles (trademark name: ESQUARTZ H-2001, produced by Shinnitetsu Kagaku Kabushiki Kaisha) were replaced by aluminum oxide fine particles of 0.5 $\mu$m in mean particle size (trademark name: Aerosil Aluminum Oxide C, produced by Degussa Company), to thereby obtain a specimen comprising a water repellent material layer formed on the surface of a polysulfone plate.

Experiment 1-6

The procedures of Experiment 1-1 were repeated, except that the silica spherical fine particles (trademark name: ESQUARTZ H-2001, produced by Shinnitetsu Kagaku Kabushiki Kaisha) were replaced by magnesium oxide fine particles of 0.8 μm in mean particle size (trademark name: Magnesia U-30, produced by Ube Chemical Industries Co., Ltd.), to thereby obtain a specimen comprising a water repellent material layer formed on the surface of a polysulfone plate.

Experiment 1-7

The procedures of Experiment 1-1 were repeated, except that the silica spherical fine particles (trademark name: ESQUARTZ H-2001, produced by Shinnitetsu Kagaku Kabushiki Kaisha) were not used, to thereby obtain a specimen comprising a water repellent material layer formed on the surface of a polysulfone plate.

As for the water repellent material layer of each of the specimens obtained in the above experiments, distribution state of the fine particles therein, distribution density of the fine particles at the surface thereof, and contact angle against ink at the surface thereof were evaluated in the following evaluation manner.

(1) Evaluation of Distribution State of the Fine Particles

Examination was made of how the fine particles are distributed in the water repellent material layer formed on the polysulfone plate. That is, firstly, as for the homogenized water repellent resin composition, the distribution state of the fine particles therein was observed by means of a microscope. Then, in order to observe whether or not the initial distributed state of the fine particles could be maintained until the fixing treatment of the water repellent resin composition applied on the polysulfone plate, a part of the starting water repellent resin composition as a sample was allowed to stand for an hour without being fixed, and thereafter, the distribution state of the fine particles was observed by means of the microscope.

On the basis of the observed results, evaluation was conducted based on the following criteria:

◎: the case wherein the fine particles are distributed in an excellent distribution state in the entire region, ○: the case wherein the fine particles are uniformly distributed substantially in the entire region, Δ: the case wherein the fine particles are not distributed in a substantially uniform state but the distributed state seems not to provide a problem of causing an unevenness in terms of the water repellent effect, and X: the case wherein the fine particles are unevenly distributed and the distributed state is considered to cause an unevenness in terms of the water repellent effect.

The evaluates results obtained are collectively shown in Table 1.

Figure 9:
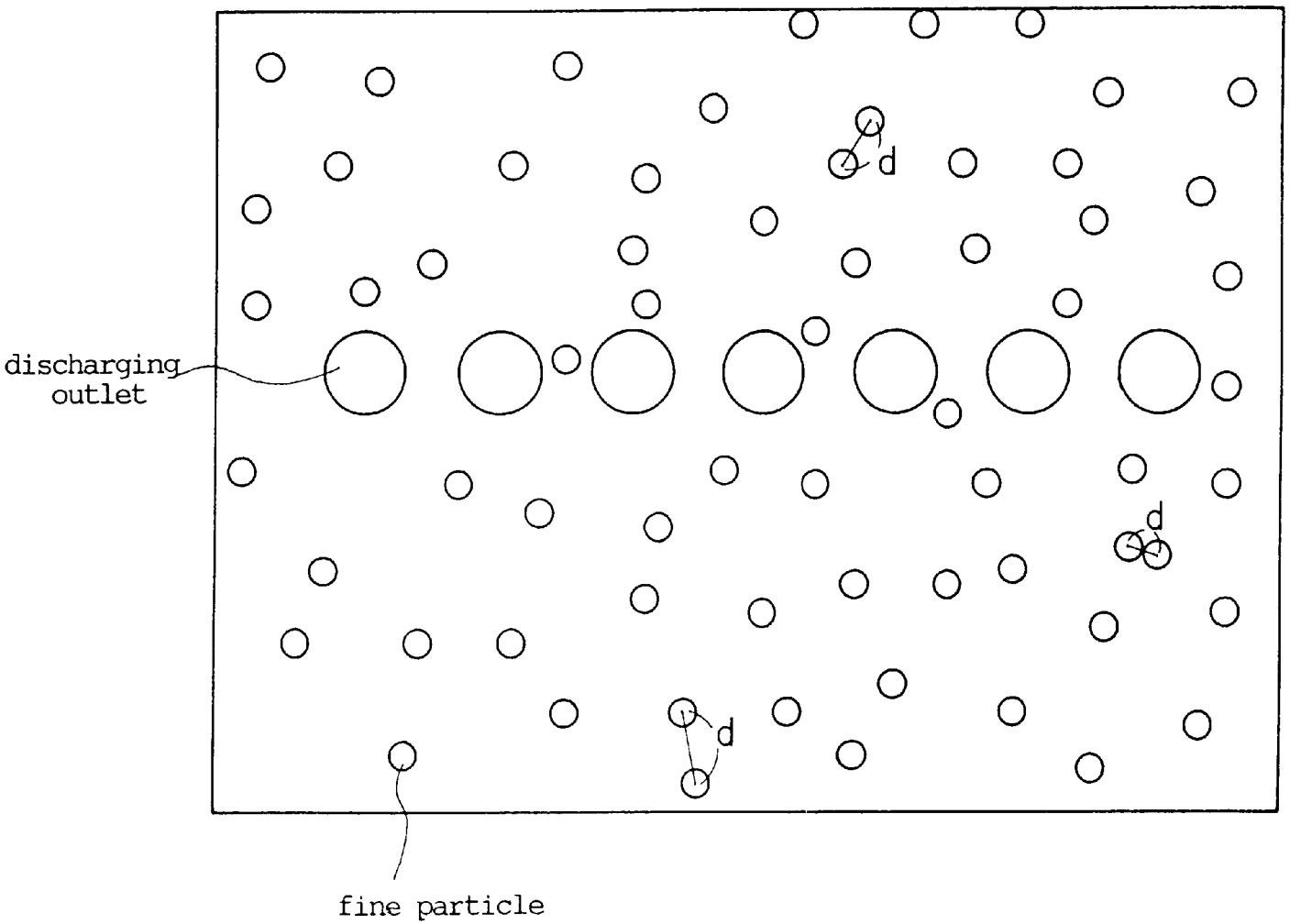
FIG. 9 is a schematic view for explaining the distribution state of fine particles of a given inorganic material in a water repellent material layer according to the present invention.

(2) Evaluation of Distribution Density of the Fine Particles at the Surface of the Water Repellent Material Layer In order to examine the distribution state of the fine particles in the water repellent material layer after having been fixed, the distribution state of the fine particles at the surface of the layer was observed. That is, firstly, a microphotograph of the surface of the water repellent material layer formed on the polysulfone plate was obtained. On the microphotograph, 100 of the fine particles appearing on the surface of the water repellent material layer as shown in FIG. 9 were randomly selected as sample fine particles. And a fine particle situated to be closest to one of the sample fine particles was selected, and the distance between the center of the former and that of the latter was measured. This measurement was conducted as for the remaining sample fine particles.

The measured results are collectively shown in Table 1.

It should be understood that the narrower the distance between each adjacent fine particles is, the better the distribution density of the fine particles is.

(3) Evaluation of Contact Angle (the Initial Contact Angle and the Contact Angle after Having Been Rubbed)

In order to examine the water repellent effect of the water repellent material layer, a contact angle (a forward contact angle) was measured at each of 10 randomly selected positions of the surface of the water repellent material layer by means of a contact angle meter CA-D produced by Kyowas Kaimenkagaku Kabushiki Kaisha at the initial stage and after having been rubbed. The results obtained are collectively shown in Table 1.

In the above, as the ink used upon the contact angle measurement, the ink for use in a Bubble Jet Cartridge BC-01 (produced by Canon Kabushiki Kaisha) was used.

Incidentally, it is generally known that the larger the contact angle is, the fewer the occasion for ink to be deposited on the discharging outlet face is and wherein the discharging outlet face is good in terms of the water repellent effect to provide printed images having good quality.

In this evaluation, for the purpose of evaluating the abrasion resistance of the water repellent material layer, examination was made of the initial contact angle and the contact angle after having been rubbed.

It is considered that the water repellent material layer will be deteriorated in terms of the contact angle (i) when the water repellent resin is chemically deteriorated or (ii) when the water repellent resin or the fine particles are partially removed.

In the above, the measurement of the initial contact angle was conducted as for the water repellent material layer before use, and the measurement of the remaining contact angle was conducted as for the water repellent material layer after having been treated by a durability examining instrument 3000 times.

Based on the results shown in Table 1, the following facts were obtained. That is, the water repellent material layer containing the fine particles is significantly superior to a conventional water repellent layer not containing such fine particles in terms of deterioration in the contact angle. This means that the incorporation of the fine particles improves the water repellency agent in terms of its abrasion resistance.

Even in the case where the water repellency agent is incorporated with fine particles, a sufficient water repellent effect is not always provided. That is, as for each of the water repellent material layers obtained in Experiments 1–4 and 1–6, there is found a tendency for ink droplets to be gathered at certain places of the surface thereof. In the case where any of these water repellent material layers is applied to the discharging outlet face of an ink jet recording head, this phenomenon possibly leads to making those coalesced ink droplets to impart negative influences to ink droplets discharged from the discharging outlets.

It is considered that the phenomenon is caused due to a variation in the contact angle. That is, having a variation in terms of the contact angle of the surface of a water repellent material layer means that the water repellent material layer is varied in terms of the water repellent effect and the surface thereof is accompanied by relatively hydrophilic portions and hydrophobic portions.

Based on the results obtained in the above experiments, it was found that the cause of causing a variation in the contact angle depends on the distribution state of the fine particles. In fact, in the case where the fine particles are unevenly distributed, the mixing ratio between the fine particles and the water repellent resin is eventually greatly varied for some regions of the water repellent material layer, wherein the regions in which the fine particles are distributed at a relatively higher distribution density are smaller in terms of the content of the water repellent resin in comparison with the remaining regions and this situation causes a variation in terms of the water repellent effect. In this case, even though there is found a certain improvement in the water repellent effect as a whole, ink droplets are readily gathered in the less water repellent areas, and because of this, the water repellent material layer in this case is poor in terms of the water repellent effect. Therefore, it is desired for the distribution state of the fine particles in the water repellent material layer to be made such that the fine particles are substantially uniformly distributed in the water repellent material layer in a state of not causing a variation in terms of the water repellent effect of the layer surface.

With respect to the mean particle size of the fine particles, the viscosity of the water repellent resin, and the affinity between the water repellent resin and the fine particles, since the mean particle size of the fine particles is determined to be of a limited value (desirably, 0.5 $\mu$m or less) in connection to the discharging outlet's opening area and while having a due care so that any negative influence is not imparted to the ink discharging by the discharging outlets as above described, it was found that at least when the viscosity of the water repellent resin is 20 cps, almost the combinations of the water repellent resins and the fine particles in the above experiments provide a good distribution state of the fine particles.

Based on this finding, the following experiment (that is, Experiment 2) was conducted.

In addition, of the combinations of the water repellent resins and the fine particles in the above experiments, in the case of the combination of the perfluorocyclopolymer and the magnesium oxide fine particles, the distribution state of the fine particles was not so good. The reason for this is considered to be that the affinity between the perfluorocyclopolymer and the magnesium oxide fine particles is not sufficient.

Experiment 2

In the following experiments (Experiments 2-1 through 2-18), on the basis of the findings obtained in the above Experiment 1, various water repellent resin compositions each comprising a different combination of a given water repellent resin and fine particles of a given inorganic hard material were provided, and using each of these water repellent resin compositions, the surface of a discharging outlet face for an liquid jet printing head was treated to thereby obtain various liquid jet printing heads. By operating each of these liquid jet printing heads, evaluation was conducted with respect to its water repellent effect and abrasion resistance during the printing operation, giving the usefulness of each of the water repellent resin compositions.

Experiment 2-1

Perfluorocyclic ether (trademark name: CTsolve 100, produced by Asahi Glass Co., Ltd.) was added to perfluorocyclopolymer (trademark name: CYTOP CT-805A, produced by Asahi Glass Co., Ltd.) to obtain a resin liquid having a viscosity of 20 cps. The resin liquid thus obtained was mixed with silica spherical fine particles of 0.1 $\mu$m in mean particle size (trademark name: ESQUARTZ H2001, produced by Shinnitetsu Kagaku Kabushiki Kaisha) in an amount corresponding to 1/10 part by weight of the resin liquid, to thereby obtain a mixture. The resultant mixture was introduced into a homogenizer, wherein the mixture was well homogenized to obtain a water repellent resin composition. There was then provided a grooved top plate made of thermoplastic resin polysulfone (trademark name: UDEL) having a nozzle plate with a discharging outlet face for an ink jet cartridge (that is, a BJ Cartridge BC-01 produced by Canon Kabushiki Kaisha).

The above water repellent resin composition was applied onto the discharging outlet face in an amount to provide a 1 $\mu$m thick layer when dried, followed by subjecting the resultant to fixing treatment in a clean oven filled with nitrogen gas wherein it was dried at 100° C. for an hour. At the discharging outlet face having the water repellent treating layer thereon, 70 discharging outlets each having an opening area of 1000 $\mu m^2$ were formed by means of KrI excimer laser ($\lambda$=248 nm) (trademark name: INDEX 200K, produced by Lumonics Company) under conditions of 1.5 $J/cm^2 \cdot$pulse×200 pulse. By this, a nozzle member having a water repellent material layer containing the inorganic hard fine particles being substantially uniformly distributed in the peripheral portions of the discharging outlets for a liquid jet printing head was completed.

Separately, there was provided a substrate for a liquid jet printing head, being provided with electrothermal converting bodies. This substrate was joined to the above grooved top plate to thereby obtain a liquid jet printing head.

By repeating the above procedures, there were obtained a plurality of liquid jet printing heads.

Experiment 2-2

The procedures of Experiment 2-1 were repeated, except that the water repellent resin composition was replaced by a resin composition comprising photoradical polymerization type fluorine-contained resin (trademark name: DEFENSA 7710, produced by Dainippon Ink and Chemicals Incorporated), xylene/methyl isobutyl ketone, and silica spherical fine particles (trademark name: ESQUARTZ H-2001, produced by Shinnitetsu Kagaku Kabushiki Kaisha), to thereby obtain a liquid jet printing head.

By repeating the above procedures, there were obtained a plurality of liquid jet printing heads.

Experiment 2-3

The procedures of Experiment 2-1 were repeated, except that the water repellent resin composition was replaced by a resin composition comprising fluoroethylene vinyl ether (trademark name: LUMIFLON, produced by Asahi Glass Co., Ltd.), xylene/methyl isobutyl ketone, and silica spherical fine particles (trademark name: ESQUARTZ H-2001, produced by Shinnitetsu Kagaku Kabushiki Kaisha), to thereby obtain a liquid jet printing head.

By repeating the above procedures, there were obtained a plurality of liquid jet printing heads.

Experiment 2-4

The procedures of Experiment 2-1 were repeated, except that the water repellent resin composition was replaced by a resin composition comprising fluorosilicon (trademark name: KP801M, produced by Shin-Etsu Chemical Co., Ltd.), xylene/methyl isobutyl ketone, and silica spherical fine particles (trademark name: ESQUARTZ H-2001, produced by Shinnitetsu Kagaku Kabushiki Kaisha), to thereby obtain a liquid jet printing head.

By repeating the above procedures, there were obtained a plurality of liquid jet printing heads.

Experiment 2-5

The procedures of Experiment 2-1 were repeated, except that the silica spherical fine particles (ESQUARTZ H-2001) were replaced by aluminum oxide fine particles (trademark name: Aerosil Aluminum Oxide C, produced by Degussa Company), to thereby obtain a liquid jet printing head.

By repeating the above procedures, there were obtained a plurality of liquid jet printing heads.

Experiment 2-6

The procedures of Experiment 2-1 were repeated, except that the silica spherical fine particles (ESQUARTZ H-2001) were replaced by aluminum oxide fine particles (trademark name: Magnesia U-30, produced by Ube Chemical Industries Co., Ltd.), to thereby obtain a liquid jet printing head.

By repeating the above procedures, there were obtained a plurality of liquid jet printing heads.

Experiment 2-7

The procedures of Experiment 2-1 were repeated, except that the silica spherical fine particles (ESQUARTZ H-2001) were replaced by brass powder (commercially available under trading name: Brass Powder No. 7700, produced by Fukuda Kinzokuhaku Kabushiki Kaisha), to thereby obtain a liquid jet printing head.

By repeating the above procedures, there were obtained a plurality of liquid jet printing heads.

Experiment 2-8

The procedures of Experiment 2-1 were repeated, except that the silica spherical fine particles (ESQUARTZ H-2001) were not used, to thereby obtain a liquid jet printing head.

By repeating the above procedures, there were obtained a plurality of liquid jet printing heads.

Experiment 2-9

The procedures of Experiment 2-8 were repeated, except that the perfluorocyclopolymer (CYTOP CT-805A) was replaced by fluorosilicon (trademark name: KP801M, produced by Shin-Etsu Chemical Co., Ltd.), to thereby obtain a liquid jet printing head.

By repeating the above procedures, there were obtained a plurality of liquid jet printing heads.

Experiment 2-10

Perfluorocyclic ether (trademark name: CTsolve 100, produced by Asahi Glass Co., Ltd.) was added to perfluorocyclopolymer (trademark name: CYTOP CT-805A, produced by Asahi Glass Co., Ltd.) to obtain a resin liquid having a viscosity of 20 cps. The resin liquid thus obtained was mixed with silica spherical fine particles of 0.1 $\mu$m in mean particle size (trademark name: ESQUARTZ H-2001, produced by Shinnitetsu Kagaku Kabushiki Kaisha) in an amount corresponding to 1/10 part by weight of the resin liquid, to thereby obtain a mixture. The resultant mixture was introduced into a homogenizer, wherein the mixture was well homogenized to obtain a water repellent resin composition. There was then provided a grooved top plate made of thermoplastic resin polysulfone (trademark name: UDEL) having a nozzle plate with a discharging outlet face for an ink jet cartridge (that is, a BJ Cartridge BC-01 produced by Canon Kabushiki Kaisha).

The above water repellent resin composition was applied onto the discharging outlet face in an amount to provide a 1 $\mu$m thick layer when dried, followed by drying until when the material applied lost its tackiness. The nozzle member thus obtained was then immersed in a liquid comprising perfluorocyclic ether (CTsolve 100), wherein the matrix resin was partially resolved off to expose the inorganic fine particles present in the outermost layer region such that their nearly upper half appeared at the surface, and the resultant was subjected to fixing treatment by way of drying. At the discharging outlet face having, thereon, the water repellent material layer with a plurality of exposed inorganic fine particles, a plurality of discharging outlets were formed by means of excimer laser. By this, a nozzle member having a water repellent material layer containing the inorganic hard fine particles being substantially uniformly distributed in the peripheral portions of the discharging outlets and wherein some of the inorganic hard fine particles are exposed at the layer surface for a liquid jet printing head was completed.

Separately, there was provided a substrate for a liquid jet printing head, being provided with electrothermal converting bodies. This substrate was joined to the above grooved top plate to thereby obtain a liquid jet printing head.

By repeating the above procedures, there were obtained a plurality of liquid jet printing heads.

Experiment 2-11

The procedures of Experiment 2-10 were repeated, except that the perfluorocyclopolymer (CYTOP CT-805A) was replaced by fluorosilicon (trademark name: KP801M, produced by Shin-Etsu Chemical Co., Ltd.), to thereby obtain a liquid jet printing head.

By repeating the above procedures, there were obtained a plurality of liquid jet printing heads.

Experiment 2-12

60 parts by weight of perfluorocyclopolymer (trademark name: CYTOP CT-805A, produced by Asahi Glass Co., Ltd.), 40 parts by weight of fluorosilicon (trademark name: KP801M, produced by Shin-Etsu Chemical Co., Ltd.), 100 parts by weight of perfluorocyclic ether (trademark name: CTsolve 100, produced by Asahi Glass Co., Ltd.), and 10 parts by weight of silica spherical fine particles (trademark name: ESQUARTZ H-2001, produced by Shinnitetsu Kagaku Kabushiki Kaisha) were introduced into a homogenizer, wherein they were well mixed and homogenized to obtain a water repellent resin composition.

Separately, there was provided a discharging element member for a bubble jet printer BJC820J (produced by Canon Kabushiki Kaisha).

The above water repellent resin composition was applied onto the discharging outlet peripheries of the discharging element member by means of the transfer coating technique. The transfer coating in this case was conducted by applying the water repellent resin composition onto the surface of a silicone rubber disk by means of a spin coater, and press-contacting the resultant to the discharging element member fixed to a treating device by means of a hand press. The resultant was introduced into in a clean oven filled with nitrogen gas wherein the transferred water repellent resin composition on the discharging element was dried and fixed at 150° C. for an hour. By this, a nozzle member having a water repellent material layer containing the inorganic hard fine particles being substantially uniformly distributed in the peripheral portions of the discharging outlets for a liquid jet printing head was completed.

Separately, there was provided a substrate for a liquid jet printing head, being provided with electrothermal converting bodies. This substrate was joined to the above grooved top plate to thereby obtain a liquid jet printing head.

By repeating the above procedures, there were obtained a plurality of liquid jet printing heads.

Experiments 2-13 through 2-18

There were prepared six different liquid jet printing heads by repeating the procedures of Experiment 2-1, except for varying the mixing ratio between the water repellent resin and the inorganic hard fine particles.

As for each of the six different liquid jet printing heads, there were prepared a plurality of liquid jet printing heads.

Evaluation

As for the liquid jet printing heads obtained in the above experiments, evaluation was conducted with respect to distribution density of the fine particles (specifically, density of the fine particles protruded at the surface), contact angle against ink (hereinafter referred to as ink contact angle), adhesion, surface state of the discharging outlet face, and abrasion resistance in the following manner.

(1) Evaluation of Distribution Density of the Fine Particles (Density of the Fine Particles Protruded at the Surface)

In order to observe the distribution density of the fine particles in the water repellent material layer after having been hardened, the distribution density of the fine particles at the surface of the water repellent material layer was examined in the following manner. That is, a microphotograph of the discharging outlet face applied with the water repellent material layer of each liquid jet printing head was obtained. On the microphotograph, 100 of the fine particles appeared on the surface of the water repellent material layer as shown in FIG. 9 were randomly selected as sample fine particles. And a fine particle situated to be the most close to one of the sample fine particles was selected, and the center-to-center distance d between the two fine particles involved was measured. This measurement was conducted as for the remaining sample fine particles. The measured values were considered as the distribution density of the fine particles present at the surface of the water repellent material layer.

The evaluated results obtained are collectively shown in Table 2.

Herein, it should be understood that the narrower the center-to-center distance of the vine particles is, the better the distribution density of the fine particles is and the better the distribution state of the fine particles is.

(2) Evaluation of Ink Contact Angle

In order to examine the water repellent effect of the discharging outlet face of the liquid jet printing head, a contact angle (a forward ink contact angle) was measured at each of randomly selected positions of the discharging outlet face by means of a contact angle meter CA-D produced by Kyowa Kaimenkagaku Kabushiki Kaisha.

The evaluated results obtained are collectively shown in Table 2.

In the above, as the ink used upon the contact angle measurement, the ink for use in a Bubble Jet Cartridge BC-01 (produced by Canon Kabushiki Kaisha) was used.

Incidentally, it is generally known that the larger the contact angle is, the fewer the occasion for ink to be deposited on the discharging outlet face is and wherein the discharging outlet face is good in terms of the water repellent effect to provide printed images having a good quality.

In this evaluation, for the purpose of evaluating the situation for the abrasion resistance of the water repellent material layer applied on the discharging outlet face to be gradually deteriorated as the repetitive use, examination was made of the initial contact angle and the contact angle after having been subjected to the wiping operation sometimes.

It is considered that the water repellent material layer will be deteriorated in terms of the contact angle (i) when the water repellent resin is chemically deteriorated or (ii) when the water repellent resin or the fine particles are partially removed.

In the above, the measurement of the initial contact angle was conducted as for the liquid jet printing head before use, and the measurement of the remaining contact angle was conducted as for the liquid jet printing head after having been subjected to the abrasion resistance test which will be later described.

(3) Evaluation of Adhesion

As for the water repellent material layer of each liquid jet printing head, evaluation was made of adhesion and hardness.

Particularly, the liquid jet printing head was immersed in the ink for use in a Bubble Jet Cartridge BC-01 (produced by Canon Kabushiki Kaisha) for a month while maintaining the ink at 60° C. Thereafter, the liquid jet printing head was taken out, it was washed with water, followed by drying. The liquid jet printing head thus treated was subjected to a conventional tape peel test using a Scotch 810 tape produced by Smitomo 3M Kabushiki Kaisha.

This tape peel test was conducted for the following reason. That is, the water repellent material present in the peripheries of the discharging outlets is in a state to always readily contact with ink staying in a meniscus state at the discharging outlets, wherein the water repellent material should be continuously contacted with the ink over a long period of time, problems entail in that the water repellent material is chemically changed or swelled, and because of this, it is often removed. In view of thin in order to grasp the situation for the water repellent material to be possibly removed due to the contact with the ink as accurate as possible, the above tape peel test was conducted.

The evaluation of the adhesion based on the results of the tape peel test was conducted based on the following criteria:

○: the case wherein no removal of the water repellent material is occurred,

Δ: the case wherein the water repellency agent or the fine particles are partially removed but the water repellent material layer is practically acceptable, and X: the case wherein apparent removal of the water repellent material is occurred and the water repellent material is not practically acceptable.

The evaluated results obtained are collectively shown in Table 2.

(4) Evaluation of Surface State of the Discharging Outlet Face

It is considered that in the case where either the discharging outlet face of an ink jet printing head or the cleaning blade used in the wiping operation is deposited with foreign matter including dust or the like or in the case where a printing sheet such as a paper is contacted with the discharging outlet face due to trouble in the transportation of the printing sleet, the water repellent material layer of the discharging outlet face is liable to suffer from damage, particularly when the water repellent material layer is low in hardness, wherein the water repellent material layer which is partially damaged is not even in terms of the water repellent effect wherein ink droplets on the partially damaged water repellent material layer are readily gathered at the respective damaged portions of the water repellent material layer. The discharging outlet face in this case is not satisfactory in terms of the water repellent effect.

In view of this, in order to examine the situation for the discharging outlet face of each of the liquid jet printing head obtained in the above experiments suffering from damage, after having subjected the liquid jet printing head to the latter-described abrasion resistance test, the discharging outlet face thereof was observed by means of a microscope.

Based on the observed results by the microscope, the evaluation was conducted based on the following criteria:

○: the case wherein no damage defect is observed,

Δ: the case wherein slight damage defects are observed, and

X: the case wherein apparent damage defects are observed.

The evaluated results obtained are collectively shown in Table 2.

(5) Evaluation of Abrasion Resistance

As for the water repellent material layer of the liquid jet printing head, its abrasion resistance upon the contact with a cleaning blade used in the wiping operation.

In this evaluation, there was conducted the so-called blade-wiping durability test. That is, as for each liquid jet printing head except for the liquid jet printing head obtained in Experiment 2-12, there was provided a Bubble Jet Printer BJC10V (produced by Canon Kabushiki Kaisha) in which the liquid jet printing nead is mounted. As for the remaining liquid jet printing head, there was provided a Bubble Jet Printer BJC820J (produced by Canon Kabushiki Kaisha) in which it is mounted.

Each of these bubble jet printers was subjected to the blade-wiping durability test with the following mode comprising: (i) provisional discharging within cap, (ii) carriage reciprocation, and (iii) blade wiping. This mode was repeated 5,000 times and 15,000 times.

As the cleaning blade, there were used a cleaning blade made of H-NBR and having a thickness of 0.6 mm in the case of the bubble jet printer BJ10V and a cleaning blade made of etheric polyurethane having a thickness of 0.7 mm in the case of the bubble jet printer BJ820J.

In general, upon cleaning the discharging outlet face of a liquid jet printing head to remove ink and other foreign matter deposited on thereon, the discharging outlet face is firstly sucked by means of a pump so as to allow those deposits to be readily removed and then the discharging outlet face is subjected to the wiping operation by means of the cleaning blade. In this case, when the sucking operation by the pump is omitted, it is necessary for the wiping operation to be conducted by contacting the cleaning blade to the discharging outlet face at an increased contact pressure (an increased blade wiping pressure) which is higher than that employed in the ordinary case. Considering this situation, in this evaluation, there were employed the ordinary blade wiping pressure and an increased wiping pressure using a cleaning blade having a thickness twice thicker than the ordinary cleaning blade. In each case, the wiping operation using a given cleaning blade was repeated 5,000 times and 15,000 times.

Now, in the evaluation, first, the foregoing liquid jet printing heads obtained in each of the above experiments were subjected to printing operation in the conventional manner. And 100 of the liquid jet printing heads which attained satisfactory results were provided for each cleaning blade having a different thickness. These liquid jet printing heads were then subjected to the above blade-wiping durability test in the above described manner. Then, thereafter, they were subjected to printing operation, wherein the number of the liquid jet printing heads having caused a defective print was examined. The results obtained are collectively shown in Table 2.

In the evaluation of the above printing performance, the liquid jet printing head having caused any of the following defects (i) to (v) with respect to a printed image obtained was considered to be defective one. That is, (i) appearance of white line blank: which is caused when defective discharging is occurred with a certain discharging outlet or when ink discharged from a certain discharging outlet is deviated in an upward or downward direction, (ii) appearance of line irregularity: which is caused when ink discharged from a certain discharging outlet is deviated in a right or left direction, (iii) appearance of splash: which means appearance of minute ink dots around a given deposited ink dot, which is occurred when minute ink droplets are splashed due to defective discharging, (iv) appearance of uneven density (variable density line): which is caused when ink discharged from a certain discharging outlet is slightly deviated in an upward or downward direction, and (v) appearance of melange print: which is caused due to irregular discharging.

(5) Total Evaluation

The above described evaluation items (i) to (v) were totally evaluated based on the following criteria:

◎: the case which is completely free of any of the above defects,

○: the case which is not completely free from one of the above defects but is usable in practice, Δ: the case which is not completely free of two or more of the above defects but is practically acceptable, and X : the case which is accompanied by all of the above defects and is not practically usable.

The evaluated results obtained are collectively shown in Table 2.

In the following, description will be made of the ink jet printing apparatus used in the above evaluation for amounting any of the foregoing liquid jet printing heads.

FIG. 1 is a schematic view illustrating the principal part of an ink jet recording apparatus (IJRA) which is provided with one of the foregoing liquid jet printing head as an ink jet head cartridge (IJC).

In the figure, reference numeral 20 indicates a detachable ink jet recording head cartridge (IJC) which is provided with a plurality of ink discharging outlets opposite the recording face of a recording sheet (not shown) transported on a platen 24 Reference numeral 16 indicates a carriage (HC) for holding the IJC 20 thereon. The carriage is connected to part of a driving belt 18 which serves to transmit a driving force from a driving motor 17, and it is designed such that it can be moved while sliding on a pair of guide shafts 19A and 19B being arranged in parallel with each other. By this, the IJC 20 is made capable of moving back and forth along the entire width of the recording sheet.

Reference numeral 26 indicates a head recovery device which is disposed at a predetermined position within the range in which the IJC 20 is moved, specifically, for example, at a position opposite the home position. The head recovery device 26 performs capping to the discharging outlets of the IJC 20 by a riving force from a motor 22 through a driving mechanism 23. In connection with the capping performance to the discharging outlets of the IJC 20 by means of a cap 26A of the head recovery device 26, ink is forced to discharge through the discharging outlets to thereby conduct recovery treatment including removal of foreign matters such as viscid ink material present in the inside of each of the discharging outlets. When the recording is terminated, the capping is performed to the discharging outlets. By this, the IJC 20 is protected.

Reference numeral 30 indicates a cleaning blade made of silicon rubber capable of serving as a wiping member which is disposed at a side face of the head recovery device 26. The cleaning blade 30 is held at a blade holding member 30A in cantilever manner, and it is operated, as well as in the case of the head recovery device 26, by means of the motor 22 and the driving mechanism 23 so as to encounter the outlet face of each of the discharging outlets of the IJC 20. By this, the cleaning blade 30 is projected in the range in which the IJC 20 is moved on appropriate timing during the recording operation by the IJC 20 or after recovery treatment by using the head recovery device 26, whereby dew drops, moisture, dust or the like deposited on discharging outlet face of the IJC 20 can be swabbed.

Based on the results shown in Table 2, the following findings were obtained.

As for the distribution of the fine particles, there is occurred a variation in terms of the distribution density not only in the case where the brass powder was used but also in the case where the silica fine particles were used in a relatively small amount. The reason for this is considered due to considerable unevenness in terms of the particle size in the former case and due to excessively small amount of the fine particles in the latter case.

As for the ink contact angle, the initial ink contact angle in the case where the fine particles are contained is higher than that in the case where the fine particles are not contained. Particularly, when the fine particles are contained such that some of them are protruded at the surface of the water repellent material layer, there is provided an apparent improvement in terms of the initial ink contact angle. The reason why such improvement is provided is considered such that by having formed irregularities by the protruded fine particles at the surface of the water repellent material layer, the irregular surface of the water repellent material layer becomes to have a certain inclination to the nozzle plate face and this inclination is functionally effected to the ink contact angle possessed by the water repellent material layer itself, whereby such improvement is provided.

As for the ink contact angle after the durability test, the ink contact angle in the case where the fine particles are contained is hardly decreased even in the case of using the cleaning blade having a thickness at least twice that of the ordinary cleaning blade. This is considered to be due to the reasons that the water repellent material layer containing the fine particles has an improved hardness, it is hardly removed, and it has an improved abrasion resistance. As for the adhesion, there is occurred a removal of the fine particles in the case of Experiment 2-2 wherein the photoradical polymerization type fluorine-contained resin is used as the water repellent resin, in the case of Experiment 2-6 wherein the magnesium oxide fine particles are used, and in the cases of Experiments 2-17 and 2-18 wherein the mixing ratio of between the water repellent resin and the silica fine particles is 100:20 or above. The reason why such removal is occurred in the precedent two cases is considered to be due to insufficient compatibility of the water repellent resin with the fine particles. As for the remaining two cases, it is considered to be due to relatively small amount of the fine particles used.

As for the surface state of the discharging outlet face, the incorporation of the fine particles into the water repellent material layer makes the discharging outlet face to be hardly suffered from a damage. However, in the case wherein the photoradical polymerization type fluorine-contained resin is used as the water repellent resin and in the case wherein brass powder is used as the fine particles, the discharging outlet face is somewhat damaged when the cleaning blade having a thickness at least twice that of the ordinary cleaning blade. The reason for this is considered to be due to insufficient hardness of the surface of the water repellent material layer because of the use of the water repellent resin or the particles.

Independently, there was found a color change for the water repellent material layer containing the brass powder after the durability test. The reason for this is considered to be due to occurrence of corrosion.

In the case where no inorganic fine particles are used, the discharging outlet face is suffered from an apparent damage particularly when the cleaning blade having a thickness twice that of the ordinary cleaning blade is used.

As for the abrasion resistance, the case of using the ordinary cleanirg blade and also in the case of using the cleaning blade having a thickness twine that of the ordinary cleaning blade, the water repellent material layer with the addition of the fine particles is surpassing the water repellent layer with no addition of the fine particles in view of providing a defective liquid jet printing head in terms of the printing performance. Particularly, in the case of using the cleaning blade having a thickness twice that of the ordinary clearing blade, the former water repellent material layer is apparently surpassing the later water repellent material layer. Based on this situation, it is understood that the addition of the fine particles provides an improvement in the abrasion resistance of the water repellency agent.

As for the liquid jet printing heads obtained, as apparent from the results of Experiments 2-1 and 2-12 through 19, it is understood that the number of defective liquid jet printing heads is relatively great in the case where the mixing ratio between the water repellent resin and the fine particles is 100:5 or less and also in the case where the mixing ratio is 100:50 or above. The reason for this in the case where the mixing ratio is 100:5 or less is considered to be due to insufficient amount of the fine particles contained, and wherein a sufficient abrasion resistance cannot be attained for the water repellent material layer. The reason for the above situation in the case where the mixing ratio is 100:50 or above is considered to be due to excessive amount of the fine particles contained, and wherein the cross-linking density of the water repellent resin is insufficient to cause a poor adhesion.

In addition, in the case where the brass powder is used, it is understood that the number of defective liquid jet printing heads is apparently great. The reason for this is considered to be due to occurrence of corrosion of the brass powder with the action of the ink.

Description will be made based on the above findings and the total evaluation results.

As apparent from the results shown in Table 2, it is understood that a liquid jet printing head applied with the water repellent treatment using a water repellent material comprising fine particles of a specific inorganic hard material contained in a specific water repellency agent according to the present invention satisfies the requirements desired for a liquid jet printing head as a whole. Particularly, when the suction recovery mechanism is not employed and the wiping pressure by means of a cleaning blade is made to be higher than that employed in the case of the conventional liquid jet printing head, the liquid jet printing head according to the present invention always exhibits a sufficient abrasion resistance, wherein the inorganic hard fine particles desirably distributed in the water repellent material layer on the discharging outlet face receives the cleaning blade which is press-contacted to the discharging outlet face at an increased contact pressure to relax the contact of the cleaning blade to the water repellent resin of the water repellent material layer whereby preventing the water repellent resin surface of the water repellent material layer. This effect is significant in the case where some of the hard fine particles are distinctly protruded at the surface of the water repellent material layer. In addition, the water repellent effect of the discharging outlet face which governs the discharging stability (the quality of an image printed in other words) is desirably improved because the use of the inorganic hard fine particles provides a desirable roughness for the surface whereby affording an improvement in the ink contact angle. Particularly, in the case where the inorganic hard fine particles are distinctly protruded at the surface of the water repellent material layer, air is sustained in the space between each adjacent protrusions to provide a further improvement in the ink contact angle. Thus, the use of the inorganic hard fine particles provides pronounced advantages in terms of the abrasion resistance and also in terms of the water repellent effect.

In addition, when either silica fine particles or aluminum oxide fine particles are used, particularly when any of these fine particles are contained such that some of the fine particles are distinctly protruded at the surface of the water repellent material layer, a significant improvement is provided in the strength of the water repellent material layer. The reason for this is considered such that silica and magnesium oxide are of relatively porous texture, and because of this, the water repellent resin is desirably entered into the porous texture of each fine particle to provide an improvement not only in the adhesion but also in the ink contact angle.

From the above description, it is understood that the present invention enables to provide a liquid jet printing head having an improved discharging outlet face excelling in abrasion resistance and also in water repellent effect and which can always continuously perform stable ink discharging to provide high quality printed images.

Of the foregoing liquid jet printing heads, those obtained in Experiments 2-1, 2-3, 2-5, 2-10, 2-12, 2-14, 2-15, and 2-16 belong to the present invention. As the water repellent treating material which is especially preferred in view of the total effectiveness, there can be mentioned those obtained in Experiments 2-1 and 2-10.

The present invention provides the most significant effects when applied in a printing head of the ink jet printing system among others, which perform printing by way of forming a fly comprising a liquid droplet utilizing a thermal energy or in a printing apparatus provided with the printing head.

A representative structure and principle of a liquid jet printing head and a liquid jet printing apparatus according to the present invention are those which adopt the fundamental principles disclosed, for example, in U.S. Pat. Nos. 4,723,129 or 4,740,796. This system is applicable to the so-called on-demand type printing system or the continuous type printing system. It is particularly effective in the case of the on-demand type printing system because by applying at least a driving signal for providing a rapid temperature rise exceeding nucleate boiling phenomenon in response to printing information to an electrothermal converting body disposed for a sheet on which liquid (ink) is carried or for a liquid pathway, the electrothermal converting body generates a thermal energy to cause film boiling at liquid (ink) on a heat acting face of the printing head and as a result, a bubble can be formed in the liquid (the ink) in a one-by-one corresponding relationship to such driving signal. By such growth and contraction of a bubble, the liquid (the ink) is discharged through a discharging outlet to produce at least a droplet. If the driving signal has a pulse shape, the growth and contraction of a bubble take place promptly and appropriately, and consequently, discharging of the liquid (the ink) which is superior particularly in responsibility can be achieved, which is further desirable. As the driving signal of such pulse shape, such driving signals as are disclosed in U.S. Pat. Nos. 4,463,359 or 4,345,262 are suitable. It is to be noted that further desirable printing can be achieved if such conditions as described in U.S. Pat. No. 4,313,124 of the invention relating to a rate of temperature rise of the heat acting face are employed.

The structure of the printing head may be such as disclosed in U.S. Pat. Nos. 4,558,333 or 4,459,600 wherein the heat acting portion is disposed at a bent portion, in addition to the structure (linear liquid flow pathway or perpendicular liquid flow pathway) described in the foregoing patent literatures, comprising discharging outlets, liquid pathways and electrothermal converting bodies.

In addition, the present invention is applicable to the structure disclosed in Japanese Patent Laid-open application No. 123670/1984 wherein a common slit is used as the discharging outlet for plural electrothermal converting bodies, and also to the structure disclosed in Japanese Patent Laid-open application No. 138461/1984 wherein an opening for absorbing pressure wave of a thermal energy is disposed to correspond to the discharging portion.

The present invention is effective also in the so-called full-line type printing head having a length corresponding to the maximum printing width. Such printing head may be a structure established by properly combining a plurality of the recording heads disclosed in the above patent literatures so as to satisfy the requirement of the length, or a single full-line head obtained by integrating those recording heads.

Further, the present invention is effectively applicable also to a replaceable chip type printing head electrically connected with an apparatus body in which ink can be supplied from the apparatus body or to a cartridge type printing head having an integral ink container.

It is desirable for the liquid jet printing apparatus according to the present invention to be provided with a recovery means and an auxiliary means for the preliminary operation. In this case, the liquid jet printing apparatus of the present invention is further stabilized. As for such means, there can be mentioned capping means pressing or sucking means, preliminary heating means by an electrothermal transducer, a heating element other than the electrothermal transducer or a combination of these, and means for performing the preliminary discharging mode other than the discharging for printing. The provision of these means makes the liquid jet printing apparatus to perform stable printing.

Further in addition, the present invention is very effective not only in a recording apparatus which has, as the recording mode, a recording mode of a main color such as black, but also in a recording apparatus which includes a plurality of different colors or at least one of full colors by color mixture whether a recording head may be constructed as a single color or a combination of a plurality of recording heads may provided.

While the above description of the present invention is of the case of using liquid ink, in the present invention, there can be employed ink which has a solid state at room temperature only if it is softened at room temperature. Since the ink jet printing apparatus above described commonly effect temperature control such that the temperature of the ink itself is adjusted within a range of from 30° C. to 70° C. to maintain the viscosity of the ink within a stable discharging range, any ink can be used as long as it assumes a liquid state when a printing signal is applied thereto. Further, in the present invention, it is possible to use ink having such a characteristic that makes it possible to positively prevent the printing head or ink from suffering from an excessive temperature rise due to thermal energy by consuming the thermal energy for the state change of the ink from the solid state to the liquid state or that it may be solidified in a left condition for the purpose of prevention of evaporation thereof. In any case, it is possible to use any ink having a property that it is first liquefied upon the application of thermal energy. Specific examples are those inks which may be liquefied and discharged in the form of liquid ink upon the application of thermal energy in response to a printing signal and those inks which start solidifying upon arrival at a printing medium. In such an instance, the form may be employed wherein the ink is opposed to an electrothermal converting body in a condition wherein it is held in the form of liquid or as a solid substance in a recessed portion of a porous sheet or a through-hole as disclosed in Japanese Patent Laid-open application No. 56847/1979 or Japanese Patent Laid-open application No. 71260/1985.

In the present invention, the most effective arrangement to the individual inks above described is an arrangement which executes the foregoing film boiling method.

TABLE 1

| | Experiments | | | | | | |
|---|---|---|---|---|---|---|---|
| | 1-1 | 1-2 | 1-3 | 1-4 | 1-5 | 1-6 | 1-7 |
| fine particles | silica (ESQUARTZ M2001) | silica (ESQUARTZ M2001) | silica (ESQUARTZ M2008) | silica (ESQUARTZ M2008) | alumina (Aerosil Aluminum Oxide C) | magnesium oxide (Magnesia U-30) | not used |
| resin viscosity (cps) | 20 | 100 | 20 | 100 | 20 | 20 | 20 |
| mean partical size of the fine particles (μm) | 0.1 | 0.1 | 0.8 | 0.8 | 0.5 | 0.8 | — |
| distribution state | ◎ | ○ | ○ | Δ | ○ | Δ | — |
| distribution density at the surface (μm) | 0.1~1.4 | 0.1~1.5 | 0.8~3.0 | 0.8~3.2 | 0.5~2.5 | 0.8~3.3 | — |
| initial contact angle (°) | 99 ± 0 | 98 ± 1 | 96 ± 2 | 94 ± 5 | 96 ± 2 | 95 ± 5 | 95 ± 0 |
| contact angle after having been rubbed (°) | 92 ± 0 | 91 ± 1 | 89 ± 2 | 85 ± 5 | 91 ± 2 | 89 ± 5 | 78 ± 5 |

TABLE 2

| | | | Experiments | | | | | | | | |
|---|---|---|---|---|---|---|---|---|---|---|---|
| | | | 2-1 | 2-2 | 2-3 | 2-4 | 2-5 | 2-6 | 2-7 | 2-8 | 2-9 |
| water-repellent resin | FEVE (LUMIFLON) | | | | 100 | | | | | | |
| | photo radical polymerization type fluorine-contained resin (DEFENSA) | | | 100 | | | | | | | |
| | fluorosilicon (KP801M) | | | | | 100 | | | | | 100 |
| | perfluoro-cyclopolymer (CYTOP) | | 100 | | | | 100 | 100 | 100 | 100 | |
| fine particles | silica (H-2001) | | 10 | 10 | 10 | 10 | | | | | |
| | alumina (Aerosil Aluminum Oxide C) | | | | | | 10 | | | | |
| | magnesium oxide (Magnesia) | | | | | | | 10 | | | |
| | brass powder (No.7700) | | | | | | | | 10 | | |
| surface state of the discharging outlet face | | | ○ | Δ | ○ | Δ | ○ | Δ | Δ | X | X |
| | | | 0.1~1.4 | 0.1~1.5 | 0.1~1.5 | 0.1~1.6 | 0.2~1.8 | 0.3~2.0 | 0.5~3.0 | — | — |
| initial contact angle (°) | | | 99 | 75 | 65 | 102 | 96 | 95 | 93 | 95 | 99 |
| contact angle after the test | conventional cleaning blade thickness | 5000 times | 95 | 68 | 60 | 95 | 92 | 92 | 90 | 90 | 78 |
| | | 15000 times | 90 | 66 | 58 | 85 | 90 | 89 | 87 | 85 | 72 |
| | cleaning blade thickness | 5000 times | 92 | 67 | 59 | 90 | 91 | 89 | 88 | 78 | 75 |
| | twice greater than the above | 15000 times | 88 | 65 | 55 | 86 | 87 | 87 | 85 | 75 | 70 |
| adhesion | | | ○ | Δ | ○ | Δ | ○ | Δ | ○ | ○ | Δ |
| abrasion resistance | conventional cleaning blade thickness | 5000 times | 0/100 | 2/100 | 3/100 | 3/100 | 1/100 | 1/100 | 5/100 | 1/100 | 6/100 |
| | | 15000 times | 0/100 | 4/100 | 5/100 | 7/100 | 2/100 | 2/100 | 10/100 | 3/100 | 12/100 |
| | cleaning blade thickness | 5000 times | 0/100 | 4/100 | 3/100 | 4/100 | 1/100 | 1/100 | 6/100 | 10/100 | 15/100 |
| | twice greater than the above | 15000 times | 0/100 | 6/100 | 5/100 | 10/100 | 2/100 | 2/100 | 13/100 | 18/100 | 40/100 |
| total evaluation | | | ◎ | Δ | ○ | Δ | ○ | Δ | Δ | Δ | X |

| | | Experiments | | | | | | | | |
|---|---|---|---|---|---|---|---|---|---|---|
| | | 2-10 | 2-11 | 2-12 | 2-13 | 2-14 | 2-15 | 2-16 | 2-17 | 2-18 |
| water-repellent | FEVE (LUMIFLON) | | | | | | | | | |
| | photo radical | | | | | | | | | |

TABLE 2-continued

| | | | | | | | | | | | |
|---|---|---|---|---|---|---|---|---|---|---|---|
| resin | polymerization type fluorine-contained resin (DEFENSA) | | | | | | | | | | |
| | fluorosilicon (KP801M) | | | 100 | 40 | | | | | | |
| | perfluoro-cyclopolymer (CYTOP) | | 100 | | 60 | 100 | 100 | 100 | 100 | 100 | 100 |
| fine particles | silica (H-2001) | | 10 | 10 | 10 | 2 | 5 | 7 | 15 | 20 | 50 |
| | alumina (Aerosil Aluminum Oxide C) | | | | | | | | | | |
| | magnesium oxide (Magnesia) | | | | | | | | | | |
| | brass powder (No.7700) | | | | | | | | | | |
| surface state of the discharging outlet face | | | ○ | ○ | ○ | X | Δ | ○ | ○ | ○ | ○ |
| distribution density (center-to-center distances of the fine particles appeared at the surface: μm) | | | 0.1~1.1 | 0.1~1.1 | 0.1~1.5 | 0.1~11.0 | 0.1~6.0 | 0.1~2.5 | 0.1~1.2 | 0.1~1.0 | 0.1~1.0 |
| initial contact angle (°) | | | 102 | 103 | 104 | 95 | 96 | 98 | 98 | 98 | 96 |
| contact angle after the test | conventional cleaning blade thickness | 5000 times | 99 | 98 | 100 | 92 | 93 | 93 | 94 | 92 | 90 |
| | | 15000 times | 96 | 89 | 95 | 86 | 89 | 89 | 89 | 87 | 86 |
| | cleaning blade thickness twice greater than the above | 5000 times | 98 | 95 | 97 | 79 | 85 | 86 | 91 | 90 | 89 |
| | | 15000 times | 94 | 86 | 90 | 76 | 80 | 81 | 87 | 86 | 85 |
| adhesion | | | ○ | Δ | ○ | ○ | ○ | ○ | ○ | Δ | Δ |
| abrasion resistance | conventional cleaning blade thickness | 5000 times | 0/100 | 1/100 | 0/100 | 1/100 | 0/100 | 0/100 | 0/100 | 0/100 | 0/100 |
| | | 15000 times | 0/100 | 2/100 | 0/100 | 3/100 | 2/100 | 1/100 | 0/100 | 0/100 | 2/100 |
| | cleaning blade thickness twice greater than the above | 5000 times | 0/100 | 2/100 | 0/100 | 3/100 | 2/100 | 0/100 | 0/100 | 0/100 | 2/100 |
| | | 15000 times | 0/100 | 5/100 | 0/100 | 7/100 | 3/100 | 1/100 | 1/100 | 1/100 | 3/100 |
| total evaluation | | | ◎ | Δ | ○ | Δ | ○ | ○ | ○ | Δ | Δ |

What is claimed is:

1. A liquid jet printing head includes a discharging outlet for discharging a printing liquid, an energy generating element for generating energy for discharging said liquid through said discharging outlet and a discharging outlet face at which said discharging outlet is disposed, characterized in that said discharging outlet face has a water repellent material layer comprising a plurality of fine particles of an inorganic material distributed in a water repellent resin in a desired distribution state wherein an amount of said fine particles of said inorganic material contained in said water repellent material layer is in a range of between 7 and 15 parts by weight versus 100 parts by weight of said water repellent resin and wherein some of said inorganic material fine particles are spacedly protruded at a surface of said water repellent material layer.

2. A liquid jet printing head according to claim 1, wherein the water repellent resin is selected from the group consisting of fluoroolefin-vinyl ether alternating copolymers, photoradical polymerization type fluorine-contained resins comprising reactive oligomers and diluent monomers, copolymerization type fluorine-contained polymers, fluorosilicons, and perfluorocyclopolymers.

3. A liquid jet printing head according to claim 1, wherein the inorganic material is selected from the group consisting of silica, alumina and magnesia.

4. A liquid jet printing head according to claim 1, wherein the energy generating element comprises an electrothermal converting body.

5. A liquid jet printing head according to claim 1, wherein the inorganic material fine particles are substantially uniformly distributed in the water repellent material layer.

6. A liquid jet printing head according to claim 1, wherein the inorganic material fine particles are of 1.0 μm or less in mean particle size.

7. A liquid jet printing head according to claim 6, wherein the inorganic material fine particles are of 0.5 μm or less in mean particle size.

8. A liquid jet printing apparatus comprising: a liquid jet printing head including a discharging outlet for discharging a printing liquid, an energy generating element for generating energy for discharging said liquid through said discharging outlet and a discharging outlet face at which said discharging outlet is disposed; and means for supplying a driving signal to said energy generating element of said liquid jet printing head, characterized in that said discharging outlet face of said liquid jet printing head has a water repellent material layer comprising a plurality of fine particles of an inorganic material distributed in a water repellent resin in a desired distribution state wherein an amount of said fine particles of said inorganic material contained in said water repellent material layer is in a range of between 7 and 15 parts by weight versus 100 parts by weight of said water repellent resin and wherein some of said inorganic material fine particles are spacedly protruded at a surface of said water repellent material layer.

9. A liquid jet printing apparatus according to claim 8, wherein the water repellent resin is selected from the group consisting of fluoroolefin-vinyl ether alternating copolymers, photoradical polymerization type fluorine-contained resins comprising reactive oligomers and diluent monomers, copolymerization type fluorine-contained polymers, fluorosilicons, and perfluorocyclopolymers.

10. A liquid jet printing apparatus according to claim 8, wherein the inorganic material is selected from the group consisting of silica, alumina and magnesia.

11. A liquid jet printing apparatus according to claim 8, wherein the energy generating element comprises an electrothermal converting body.

12. A liquid jet printing apparatus according to claim 8, wherein the inorganic material fine particles are substantially uniformly distributed in the water repellent material layer.

13. A liquid jet printing apparatus according to claim 8, wherein the inorganic material fine particles are of 1.0 $\mu$m or less in mean particle size.

14. A liquid jet printing apparatus according to claim 13, wherein the inorganic material fine particles are of 0.5 $\mu$m or less in mean particle size.

* * * * *

UNITED STATES PATENT AND TRADEMARK OFFICE

CERTIFICATE OF CORRECTION

PATENT NO. : 6,318,842 B1
DATED : November 20, 2001
INVENTOR(S) : Akihiko Shimomura et al.

It is certified that error appears in the above-identified patent and that said Letters Patent is hereby corrected as shown below:

Title page,
Item [62], Related U.S. Application Data, "(6362)" should read -- (62) --.

Item [56], FOREIGN PATENT DOCUMENTS,
"403133650" should read -- 03-3133650 --;
"357157765" should read -- 57-157765 --;
"361291148" should read -- 61-29148 --;
"57-175765 9/1992" should read -- 57-175765 9/1982 --.

Item [57], ABSTRACT,
Line 10, close up right margin.

Column 4,
Line 10, "which" should read -- which enables --.

Column 8,
Line 54, "description" should read -- description is --;
Line 56, "limiated" should read -- limited --.

Column 9,
Line 3, "portion 5" should read -- portion 5' --.

Column 11,
Lines 12-17, lines 12-17 should be deleted.

Column 15,
Line 50, "evaluates" should read -- evaluated --.

Column 19,
Line 4, "aluminum" should read -- magnesium --.

Column 20,
Line 43, "in" should be deleted.

UNITED STATES PATENT AND TRADEMARK OFFICE

CERTIFICATE OF CORRECTION

PATENT NO. : 6,318,842 B1
DATED : November 20, 2001
INVENTOR(S) : Akihiko Shimomura et al.

It is certified that error appears in the above-identified patent and that said Letters Patent is hereby corrected as shown below:

Column 21
Line 14, "appeared" should read -- appearing --;
Line 27, "vine" should read -- fine --.

Column 22,
Line 14, "thin" should read -- this, --;
Line 21, "is" should read -- has --;
Line 26, "is" (first occurrence) should read -- has --;
Line 61, "its" should read -- evaluation was made of its --.

Column 23,
Line 1, "nead" should read -- head --;
Line 11, "BJ10V" should read -- BJC10V --;
Line 13, "BJ820J." should read -- BJC820J. --;
Line 45, "is" (second occurrence) should read -- has --;
Line 52, "is occurred" should read -- occurs --.

Column 24,
Line 5, "amount-" should read -- mounting --;
Line 6, "ing" (first occurrence) should be deleted;
Line 9, "head" should read -- heads --;
Line 14, "24" should read -- 24. --;
Line 27, "riving" should read -- driving --.

Column 25,
Line 36, "blade." should read -- blade is used. --;
Line 49, "cleanirg" should read -- cleaning --;
Line 50, "twine" should read -- twice --;
Line 58, "later" should read -- latter --.

Column 26,
Line 33, "receives" should read -- receive --;
Line 37, "preventing" should read -- preventing damage to --.

UNITED STATES PATENT AND TRADEMARK OFFICE

CERTIFICATE OF CORRECTION

PATENT NO. : 6,318,842 B1
DATED : November 20, 2001
INVENTOR(S) : Akihiko Shimomura et al.

It is certified that error appears in the above-identified patent and that said Letters Patent is hereby corrected as shown below:

Column 28,
Line 16, "means" (first occurrence) should read -- means, --;
Line 22, "to" should read -- able to --.

Column 29,
Table 2, "photo radical" (both occurrences) should read -- photoradical --.

Column 31,
Line 2, "appeared" should read -- appearing --.

Signed and Sealed this

Eighth Day of April, 2003

JAMES E. ROGAN
*Director of the United States Patent and Trademark Office*